US012696972B2

(12) United States Patent
Kumar et al.

(10) Patent No.: US 12,696,972 B2
(45) Date of Patent: Aug. 4, 2026

(54) AUTONOMOUS VACUUM MOPPING SYSTEM

(71) Applicant: Matic Robots, Inc., Mountain View, CA (US)

(72) Inventors: Anshuman Kumar, San Francisco, CA (US); Karthik Chandrashekaraiah, San Francisco, CA (US); Nathan Elio Madonia, Mountain View, CA (US); William George Plummer, London (GB); Tristan Pierre Gervais, Sunnyvale, CA (US); Vishal Jain, Santa Clara, CA (US)

(73) Assignee: MATIC ROBOTS, INC., Mountain View, CA (US)

( * ) Notice: Subject to any disclaimer, the term of this patent is extended or adjusted under 35 U.S.C. 154(b) by 537 days.

(21) Appl. No.: 18/232,693

(22) Filed: Aug. 10, 2023

(65) Prior Publication Data

US 2024/0049936 A1 Feb. 15, 2024

Related U.S. Application Data

(60) Provisional application No. 63/396,887, filed on Aug. 10, 2022.

(51) Int. Cl.
*A46B 13/02* (2006.01)
*A47L 7/00* (2006.01)
(Continued)

(52) U.S. Cl.
CPC ..... *A46B 13/02* (2013.01); *A47L 7/0004* (2013.01); *A47L 9/248* (2013.01); *A47L 9/2821* (2013.01);
(Continued)

(58) Field of Classification Search
CPC ..... A46B 13/001; A46B 13/02; A47L 7/0004; A47L 9/0455; A47L 9/248; A47L 9/2821;
(Continued)

(56) References Cited

U.S. PATENT DOCUMENTS 9,038,233 B2 5/2015 Jones et al.
10,292,560 B2 5/2019 Doughty
(Continued)

FOREIGN PATENT DOCUMENTS

EP 1195127 A2 4/2002

OTHER PUBLICATIONS

International Search Report and Written Opinion, Patent Cooperation Treaty Application No. PCT/US2023/030002, dated Oct. 27, 2023, 17 pages.

*Primary Examiner* — Michael Leslie
(74) *Attorney, Agent, or Firm* — Fenwick & West LLP

(57) ABSTRACT

An autonomous vacuum includes mopping and sweeping functionalities. A magnetic locking system secures a cleaning head of the autonomous vacuum into a mopping position when in a mopping state, allowing the vacuum to move a mop roller back and forth to scrub stubborn stains on a floor surface without the cleaning head shifting into an alternate sweeping position. The autonomous vacuum also includes snorkel ducts to direct fluid waste and water from the mop roller to a waste bag without mixing the fluid waste with dry waste collected by a sweeping system. The snorkel ducts are configured to kink shut when the cleaning head is in a sweeping state, to avoid unnecessary suction through the snorkel system. Additionally, the mopping system includes cleaning logic routines that can sense and control mop roller saturation and drying, and that can perform automatic mop cleaning.

20 Claims, 18 Drawing Sheets

(51) Int. Cl.

| | |
|---|---|
| ***A47L 9/24*** | (2006.01) |
| ***A47L 9/28*** | (2006.01) |
| ***A47L 11/30*** | (2006.01) |
| ***A47L 11/40*** | (2006.01) |
| *A46B 13/00* | (2006.01) |
| *A47L 9/04* | (2006.01) |

(52) U.S. Cl.
CPC ..... *A47L 9/2831* (2013.01); *A47L 9/2842* (2013.01); *A47L 9/2857* (2013.01); *A47L 11/302* (2013.01); *A47L 11/4011* (2013.01); *A47L 11/4066* (2013.01); *A46B 13/001* (2013.01); *A47L 9/0455* (2013.01); *A47L 2201/00* (2013.01)

(58) Field of Classification Search
CPC .... A47L 9/2831; A47L 9/2842; A47L 9/2857; A47L 11/302; A47L 11/4011; A47L 11/4066; A47L 2201/00
See application file for complete search history.

(56) References Cited

U.S. PATENT DOCUMENTS

| | | | | |
|---|---|---|---|---|
| 10,517,454 | B2 | 12/2019 | Jones et al. | |
| 10,568,483 | B2 | 2/2020 | Lewis | |
| 11,058,271 | B2 | 7/2021 | Blouin | |
| 11,103,113 | B2 | 8/2021 | Schregardus et al. | |
| 11,116,374 | B2 * | 9/2021 | Dhindsa | A47L 11/403 |
| 11,278,173 | B2 | 3/2022 | Jones et al. | |
| 11,930,993 | B2 * | 3/2024 | Kumar | A47L 9/2826 |
| 12,161,284 | B2 * | 12/2024 | Kumar | A47L 11/201 |
| 12,478,236 | B2 * | 11/2025 | Kumar | A47L 9/0488 |
| 2003/0229421 | A1 | 12/2003 | Chmura et al. | |
| 2010/0256812 | A1 | 10/2010 | Tsusaka et al. | |
| 2010/0332067 | A1 | 12/2010 | Abramson | |
| 2019/0282055 | A1 | 9/2019 | Lee et al. | |
| 2021/0378472 | A1 | 12/2021 | Kumar et al. | |

* cited by examiner

AUTONOMOUS VACUUM MOPPING SYSTEM

CROSS REFERENCE TO RELATED APPLICATIONS

This application claims priority to and the benefit of U.S. Provisional Application No. 63/396,887 filed on Aug. 10, 2022, which is incorporated by reference in its entirety.

TECHNICAL FIELD

This disclosure relates to autonomous cleaning systems. More particularly, this disclosure describes structure and logic of a mopping system for an autonomous vacuum.

BACKGROUND

Cleaning robots can execute simple environment navigation and can perform actions like sweeping, mopping, and dust removal in various settings. However, due to the varying requirements of different cleaning tasks, cleaning robots tend to be specially designed to perform only one cleaning task. As a result, users require several different purpose-built cleaning robots to fully clean their spaces. Having separate cleaning robots for sweeping and mopping takes up extra power, and extra space in a user's home or office area. Combining the various cleaning functionalities into one system leads to complicated system interactions and issues like height discrepancies between different cleaning modes, need to secure systems into appropriate positions, additional possibilities for component loss or component jamming, and solutions for removing both wet and dry debris from a floor surface without causing system clogs.

SUMMARY

An autonomous vacuum comprises a drive system with a motor and a drive assembly. The drive system comprises a body enclosure having a first side opposite a second side, a front side opposite a back side, and a top side opposite a bottom side that is substantially parallel to a floor surface. There is a baseplate attached to the bottom side of the body enclosure and one or more baseplate magnets are rigidly attached to the baseplate and exposed on the front side of the body enclosure.

The autonomous vacuum also includes a cleaning head that is structured to engage with and clean the floor surface. The cleaning head comprises an enclosure having a first side opposite a second side, a front side opposite a back side, and a top side opposite the floor surface. in some example embodiments, a "cleaning face" can be defined as a real or imaginary surface on the cleaning head that contacts the floor during cleaning operation. As illustrated in FIG. 4. a first cleaning face of the cleaning head enclosure is connected to the front side of the cleaning head enclosure and extends backward and downward at an angle from the front side of the cleaning head enclosure. A second cleaning face of the cleaning head enclosure is connected to the back side of the cleaning head enclosure and extends forwards and downward at an angle from the back side of the cleaning head enclosure to intersect at an obtuse angle with the first cleaning face of the cleaning head enclosure. The first cleaning face and the second cleaning face thus intersect at an obtuse angle on the bottom side of the cleaning head enclosure, in one example embodiment. There is an opening within each of the cleaning faces. A first opening within the first cleaning face extends from the first side of the cleaning head enclosure to the second side of the cleaning head enclosure. A second opening within the second cleaning face extends from the first side of the cleaning head enclosure to the second side of the cleaning head enclosure. A sweeper roller is rotatably attached within the first opening and a mop roller is rotatably attached within the second opening. The cleaning head also includes a back tube comprising an exterior surface surrounding a hollow core, a first end, and a second end, wherein the first end of the back tube is attached to the back side of the cleaning head enclosure and the length of the hollow core is curved upward such that the second end of the back tube is directed upward away from the floor surface. Back tube magnets are attached to the exterior surface of the back tube opposite the back side of the cleaning head and exposed in alignment with the exposed magnetic poles of corresponding base-plate magnets.

The autonomous vacuum also includes a connection system that attaches the back tube of the cleaning head to the front side of the drive system. The connection system includes one or more four-bar linkages that secure the back side of the cleaning head enclosure to the front side of the body enclosure of the drive system, and an actuator that drives the motion of one or more four-bar linkages.

The connection system attaches the cleaning head to the drive system in two possible states. In the first sweeping state, the cleaning head enclosure is positioned above the floor surface by the actuator. The cleaning head enclosure is held such that the first cleaning face is substantially parallel to the floor surface, the first roller is exposed to the floor surface and the poles of the cleaning head magnets are distanced from the poles of the baseplate magnets such that they do not significantly attract.

In the second mopping state, the cleaning head enclosure is lowered toward the floor surface by the actuator, the cleaning head enclosure is pitched backward such that the second cleaning face is substantially parallel to the floor surface, the second roller is exposed to the floor surface, and the poles of the cleaning head magnets firmly attract to one another, securing the cleaning head into a second position.

The features and advantages described in the specification are not all inclusive and many additional features and advantages will be apparent to one of ordinary skill in the art in view of the drawings, specification, and claims. Moreover, it should be noted that the language used in the specification has been principally selected for readability and instructional purposes and may not have been selected to delineate or circumscribe the inventive subject matter.

BRIEF DESCRIPTION OF THE DRAWINGS

Figure

The figures depict various embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION

The figures (FIGS.) and the following description relate to preferred embodiments by way of illustration only. It should be noted that from the following discussion, alternative embodiments of the structures and methods disclosed herein will be readily recognized as viable alternatives that may be employed without departing from the principles of what is claimed.

Reference will now be made in detail to several embodiments, examples of which are illustrated in the accompanying figures. It is noted that wherever practicable similar or like reference numbers may be used in the figures and may indicate similar or like functionality. The figures depict embodiments of the disclosed system (or method) for purposes of illustration only. One skilled in the art will readily recognize from the following description that alternative embodiments of the structures and methods illustrated herein may be employed without departing from the principles described herein.

Overview

An autonomous vacuum includes mopping and sweeping functionalities. A magnetic locking system secures a cleaning head of the autonomous vacuum into a mopping position when in a mopping state, allowing the vacuum to move a mop roller back and forth, e.g., to scrub stubborn stains on a floor surface, without the cleaning head shifting into an alternate sweeping position. The autonomous vacuum also includes snorkel ducts to direct fluid waste and water from the mop roller to a waste bag without mixing the fluid waste with dry waste collected by a sweeping system. As compared to a common dry and wet waste ducting design, this configuration beneficially reduces issues, for example, creating a slurry-like mass (e.g., a mud-like accumulation) in the vacuum's ducts that is more difficult to clean or clear out. The snorkel ducts also are configured to kink shut when the cleaning head is in a sweeping state, to avoid unnecessary suction through the snorkel system. Additionally, the mopping system includes cleaning logic routines that can sense and control mop roller saturation and drying, and that can perform automatic mop cleaning.

System Architecture

Figure 1:
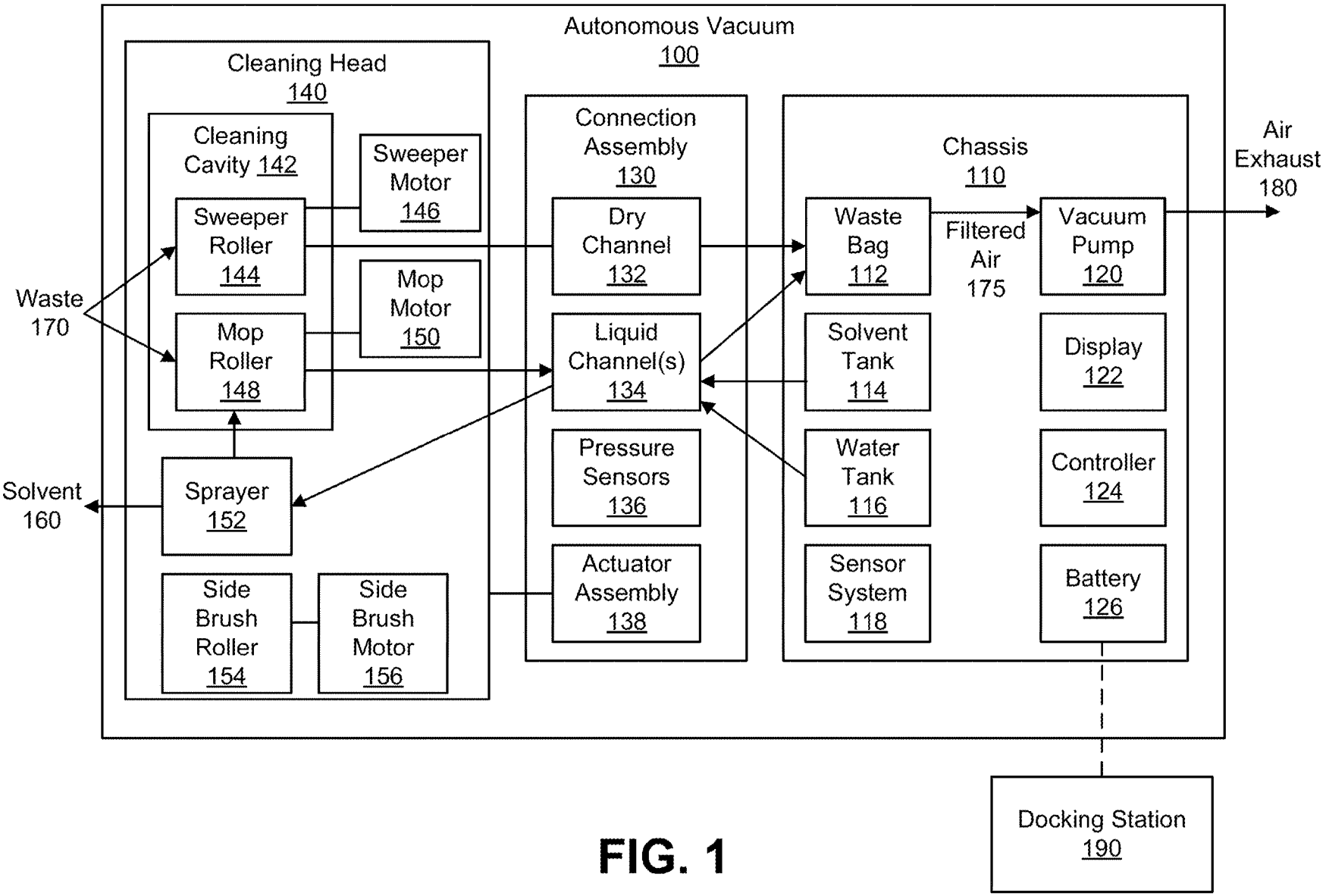
(FIG. 1 is a block diagram of an autonomous vacuum, according to one example embodiment.

Figure (FIG. 1 is a block diagram of an autonomous vacuum 100, according to one example embodiment. The autonomous vacuum 100 in this example may include a chassis 110, a connection assembly 130, and a cleaning head 140. The components of the autonomous vacuum 100 allow the autonomous vacuum 100 to intelligently clean as the autonomous vacuum 100 traverses an area within an environment.

As an overview, the chassis 110 is a rigid body that serves as a base frame for the autonomous vacuum. The chassis 110 may include two or more motorized wheels for driving the autonomous vacuum 100. The chassis 110 hosts a suite of other components for navigating the autonomous vacuum 100, communicating with external devices, providing notifications, among other operations. The connection assembly 130 serves as a connection point between the cleaning head 140 and the chassis 110. The connection assembly 130 may include two or more channels used to direct solvent, water, waste, or some combination thereof between the cleaning head 140 and the chassis 110. The connection assembly 130 also may include an actuator assembly 138 that controls movement of the cleaning head 140. The cleaning head 140 may include the one or more brush rollers used to perform cleaning operations. In some embodiments, the architecture of the autonomous vacuum 100 includes more components for autonomous cleaning purposes. Some examples include a mop roller, a solvent spray system, a waste container, and multiple solvent containers for different types of cleaning solvents. The autonomous vacuum 100 may support a variety of cleaning functions, for example, vacuuming, sweeping, dusting, mopping, and/or deep cleaning.

The chassis 110 is a rigid base frame for the autonomous vacuum 100. In one or more embodiments, the chassis 110 may include at least a waste bag 112, a solvent tank 114, a water tank 116, a sensor system 118, a vacuum pump 120, a display 122, a controller 124, and a battery 126. In other embodiments, the chassis 110 may comprise additional, fewer, or different components than those listed herein. For example, one embodiment of the chassis 110 omits the display 122. Another embodiment includes an additional output device, such as a speaker or other visual indicator (e.g., status lights). Still another embodiment may combine the solvent tank 114 and the water tank 116 into a single tank. In some cases, the chassis 110 is considered to be part of a "drive system" that includes a motor, drive assembly, and other components that enable the autonomous vacuum 100 to move and navigate within an environment.

The waste bag 112 collects the waste that is accumulated from performing cleaning routines. The waste bag 112 may be configured to collect solid and/or liquid waste. In one or more embodiments, there may be two separate waste bags 112, one for solid waste and one for liquid waste. The waste bag 112 may be removably secured within the chassis 110. As the waste bag 112 is filled, the autonomous vacuum 100 may alert the user to empty the waste bag 112 and/or replace the waste bag 112. In other embodiments, the waste bag 112 can remain in the chassis 110 when emptied. In such embodiments, the chassis 110 may further comprise a drainage channel connected to the waste bag 112 to drain the collected waste. The waste bag 112 may further comprise an absorbent material that soaks up liquid, e.g., to prevent the liquid from sloshing out of the bag during operation of the autonomous vacuum 100.

The solvent tank 114 comprises solvent used for cleaning. The solvent tank 114 comprises at least a chamber and one or more valves for dispensing from the chamber. The solvent is a chemical formulation used for cleaning. Example solvents include dish detergent, soap, bleach, other organic and/or nonorganic solvents. In some embodiments, the solvent tank 114 comprises dry solvent that is mixed with water from the water tank 116 to create a cleaning solution. The solvent tank may be removable, allowing a user to refill the solvent tank 114 when the solvent tank 114 is empty.

The water tank 116 stores water used for cleaning. The water tank 116 comprises at least a chamber and one or more valves for dispensing from the chamber. The water tank 116 may be removable, allowing a user to refill the water tank 116 when the water tank 116 is empty. In one or more embodiments, the water tank 116 comprises a valve located on the bottom of the water tank 116, when the water tank 116 is secured in the chassis 110. The weight of the water applies a downward force due to gravity, a spring mechanism, or some combination thereof, to keep the valve closed. To open the valve, some protrusion on the chassis 110 applies a counteracting upward force that opens the valve, e.g., by pushing the valve towards an interior of the chamber revealing an outlet permitting water to escape the water tank 116.

The sensor system 118 may include a suite of sensors for guiding operation of the autonomous vacuum 100. The sensor system 118 uses the sensor data to map the environment and determine and execute cleaning tasks to handle a variety of messes. The sensor system 118 is further described in FIG. 3.

The vacuum pump 120 generates a vacuum force that aids ingestion of waste by the cleaning head 140. In one or more embodiments, to generate the vacuum force, the vacuum pump 120 may include one or more fans that rotate to rapidly move air. The vacuum force flows through the waste bag 112, through the connection assembly 130, and to the cleaning head 140.

The display 122 is an electronic display that can present visual content. The display 122 may be positioned on a topside of the autonomous vacuum 100. The display may be configured to notify a user regarding operation of the autonomous vacuum 100. For example, notifications may describe an operation being performed by the autonomous vacuum 100, an error message, service needs, or the status of the autonomous vacuum 100, etc. The display 122 may be an output device that includes a driver and/or screen to drive presentation of (e.g., provides for display) and/or present visual information. The display 122 may include a user interface that allows users to interact with and control the autonomous vacuum. In some embodiments, the display may additionally or alternatively include physical interface buttons along with a touch sensitive interface. The display 122 receives data from the sensor system 118 and may display the data. The data may include renderings of a view (actual image or virtual) of a physical environment, a route of the autonomous vacuum 100 in the environment, obstacles in the environment, and messes encountered in the environment. The data also may include alerts, analytics, and statistics about cleaning performance of the autonomous vacuum 100 and messes and obstacles detected in the environment.

The controller 124 is a computing device structured to control operation of the autonomous vacuum 100 using one or more of the processes described herein. As a computing device, the controller 124 may include one or more processors and computer-readable storage media for storing program code (that include instructions) executable by the one or more processors. Operations of the controller 124 include navigating the autonomous vacuum 100, simultaneous localization and mapping of the autonomous vacuum 100, controlling operation of the cleaning head 140, generating notifications to provide to the user via one or more output devices (e.g., the display 122, a speaker, or a notification transmittable to the user's client device, etc.), running quality checks on the various components of the autonomous vacuum 100, controlling docking at the docking station 190, etc.

The controller 124 may control movement of the autonomous vacuum 100. In various embodiments, the controller 124 also monitors and manages environment mapping, sensors, detection of items and users in an environment, task lists and assignments, navigation, surface detection, user interfaces, and other logic associated with operation of the autonomous vacuum 100. The controller 124 connects to one or more motors connected to one or more wheels that may be used to move the autonomous vacuum 100 based on sensor data captured by the sensor system 118 (e.g., indicating a location of a mess to travel to). The controller 124 may cause the motors to rotate the wheels forward/backward or turn to move the autonomous vacuum 100 in the environment. Based on surface type detection by the sensor system 118, the controller 124 may modify or alter navigation of the autonomous vacuum 100.

The controller 124 of the actuator assembly 138 may also control cleaning operations. Cleaning operations may include a combination of rotation of the brush rollers, positioning or orienting the cleaning head 140 via the actuator assembly 138, controlling dispersion of solvent, activation of the vacuum pump 120, monitoring the sensor system 118, and other functions of the autonomous vacuum 100.

In controlling rotation of the brush rollers, the controller 124 may connect to one or more motors (e.g., the sweeper motor 146, the mop motor 150, and the side brush motor 156) positioned at the ends of the brush rollers. The controller 124 can toggle rotation of the brush rollers between rotating forward or backward or not rotating using the motors. In some embodiments, the brush rollers may be connected to an enclosure of the cleaning head 140 via rotation assemblies each comprising one or more of direct drive, geared, or belted drive assemblies that connect to the motors to control rotation of the brush rollers. The controller 124 may rotate the brush rollers based on a direction needed to clean a mess or move a component of the autonomous vacuum 100.

In some embodiments, the sensor system 118 determines an amount of pressure needed to clean a mess (e.g., more pressure for a stain than for a spill), and the controller 124 may alter the rotation of the brush rollers to match the determined pressure. The controller 124 may, in some instances, be coupled to a load cell at each brush roller that is used to detect pressure being applied by the brush roller. In another instance, the sensor system 118 may be able to determine an amount of current required to spin each brush roller at a set number of rotations per minute (RPM), which may be used to determine a pressure being exerted by the brush roller. The sensor system 118 may also determine whether the autonomous vacuum 100 is able to meet an expected movement (e.g., if a brush roller is jammed) and adjust the rotation via the controller 124 if not. Thus, the sensor system 118 may optimize a load being applied by each brush roller in a feedback control loop to improve cleaning efficacy and mobility in the environment. The controller 124 may additionally control dispersion of solvent during the cleaning operation by controlling a combination of the sprayer 152, the liquid channels 134, the solvent tank 114, the water tank 116, and turning on/off (operational states) the vacuum pump 120.

The autonomous vacuum 100 is powered with an internal battery 126. The battery 126 stores and supplies electrical power for the autonomous vacuum 100. In some embodiments, the battery 126 may include multiple batteries that charge specific components of the autonomous vacuum 100. The battery 126 may implement a battery optimization scheme to efficiently distribute power across the various components. The battery 126 may be rechargeable and can be recharged when the autonomous vacuum 100 is docked at the docking station 190.

The docking station 190 may be connected to an external power source to provide power to the battery 126. External power sources may include a household power source and one or more solar panels. The docking station 190 also may include processing, memory, and communication computing components that may be used to communicate with the autonomous vacuum 100 and/or a cloud computing infrastructure (e.g., via wired or wireless communication). These computing components may be used for firmware updates and/or communicating maintenance status. The docking station 190 may also include other components, such as a cleaning station for the autonomous vacuum 100. In some embodiments, the cleaning station includes a solvent tray that the autonomous vacuum 100 may spray solvent into and roll the roller 144 or the side brush roller 154 in the solvent tray for cleaning. In other embodiments, the autonomous vacuum may eject the waste bag 112 into a container located at the docking station 190 for a user to remove.

The connection assembly 130 is a rigid body that connects the cleaning head 140 to the chassis 110. A four-bar linkage may join the cleaning head 140 to the connection assembly 130. In some embodiments, the connection assembly 130 comprises a dry channel 132, one or more liquid channels 134, one or more pressure sensors 136, and an actuator assembly 138. Channel refers generally to either a dry channel or a liquid channel. The connection assembly 130 may include additional, fewer, or different components than those listed herein. For example, one or more sensors of the sensor system 118 may be disposed on the connection assembly 130.

The dry channel 132 is a conduit for conveying dry waste from the cleaning head 140 to the waste bag 112. The dry channel 132 is substantially large in diameter to permit movement of most household waste.

The one or more liquid channels 134 are conduits for conveying liquids between the cleaning head 140 and the chassis 110. There is at least one liquid channel 134 (a liquid waste channel) that carries liquid waste from the cleaning head 140 to the waste bag 112. In some embodiments, the liquid channel 134 carrying liquid waste may be smaller in diameter than the dry channel 132. In such embodiments, the autonomous vacuum 100 sweeps (collecting dry waste) before mopping (collecting liquid waste). There is at least one other liquid channel 134 (a liquid solution channel) that carries water, solvent, and/or cleaning solution (combination of water and solvent) from the chassis 110 to the cleaning head 140 for dispersal to the cleaning environment.

The one or more pressure sensors 136 measure pressure in one or more of the channels. The pressure sensors 136 may be located at various positions along the connection assembly 130. The pressure sensors 136 provide pressure measurements to the controller 124 for processing.

The actuator assembly 138 controls movement and position of the cleaning head 140, relative to the chassis 110. The actuator assembly 138 comprises one or more actuators configured to generate linear and/or rotational movement of the cleaning head 140. Linear movement may include vertical height of the cleaning head 140. Rotational movement may include pitching the cleaning head 140 to varying angles, e.g., to switch between sweeping mode and mopping mode, or to adjust cleaning by the cleaning head 140 based on detected feedback signals. The actuator assembly 138 may include a series of joints that aid in providing the movement to the cleaning head 140.

The actuator assembly 138 includes one or more actuators (henceforth referred to as an actuator for simplicity) and one or more controllers and/or processors (henceforth referred to as a controller for simplicity) that operate in conjunction with the sensor system 118 to control movement of the cleaning head 140. The sensor system 118 collects and uses sensor data to determine an optimal height for the cleaning head 140 given a surface type, surface height, and mess type.

Mess types are the form of mess (or waste) in the environment, such as small debris, dust, smudges, stains, and spills. They also include the type of phase the mess embodies, such as liquid, solid, semi-solid, or a combination of liquid and solid. Some examples of waste include bits of paper, popcorn, leaves, and particulate dust. A mess typically has a size/form factor that is relatively small compared to obstacles in the environment. For example, spilled dry cereal may be a mess but the bowl it came in would be an obstacle. Spilled liquid may be a mess, but the glass that held it may be an obstacle. However, if the glass broke into smaller pieces, the glass shards would then be a mess rather than an obstacle. Further, if the sensor system 118 determines that the autonomous vacuum 100 cannot properly clean up the glass, the glass may again be considered an obstacle, and the sensor system 118 may send a notification to a user indicating that there is a mess that needs user cleaning. The mess may be visually defined in some embodiments, e.g., in terms of visual characteristics. In other embodiments a mess may be defined by particle size or make up. When defined by size, in some embodiments, a mess and an obstacle may coincide. For example, a small interlocking brick piece may be the size of both a mess and an obstacle.

The actuator assembly 138 automatically adjusts the height of the cleaning head 140 given the surface type, surface height, and mess type. Surface types may be the floorings used in the environment and may include surfaces of varying characteristics (e.g., texture, material, absorbency), for example, carpet, wood, tile, rug, laminate, marble, and vinyl. In particular, the actuator controls vertical movement and rotation tilt of the cleaning head 140. The actuator may vertically actuate the cleaning head 140 based on instructions from the sensor system 118. For example, the actuator may adjust the cleaning head 140 to a higher height if the sensor system 118 detects thick carpet in the environment and may adjust the cleaning head 140 to a lower height if the sensor system 118 detects thin carpet. Further, the actuator may adjust the cleaning head 140 to a higher height for a solid waste spill than for a liquid waste spill.

The autonomous vacuum 100 may detect the height of obstructions and/or obstacles, and if an obstruction or obstacle is over a threshold size, the autonomous vacuum 100 may use the collected visual data to determine whether to climb or circumvent the obstruction or obstacle by adjusting the cleaning head 140 height using the actuator assembly 138. In some embodiments, the actuator may set the height of the cleaning head 140 to push larger messes out of the path of the autonomous vacuum 100. For example, if the autonomous vacuum 100 is blocked by a pile of books, the sensor system 118 may detect the obstruction (i.e., the pile of books) and the actuator may move the cleanings head 105 to the height of the lowest book, and the autonomous vacuum 100 may move the books out of the way to continue cleaning an area.

The cleaning head 140 performs cleaning operations to clean an environment. The cleaning head 140 is a rigid body that forms a cleaning cavity 142, where a sweeper roller 144 and a mop roller 148 are disposed. The cleaning head 140 further comprises a sweeper motor 146, a mop motor 150, a sprayer 152, a side brush roller 154, and a side brush motor 156. The cleaning head 140 may be referred to as a "roller housing." Collectively, the sweeper roller 144, the mop roller 148, and the side brush roller 154 are referred to as the "brush rollers." Likewise, the "brush motors" include the sweeper motor 146, the mop motor 150, and the side brush motor 156. In some embodiments, each brush roller may be composed of different materials and operate at different times and/or speeds, depending on a cleaning task being executed by the autonomous vacuum 100. The cleaning head 140 may include additional, fewer, or different components than those listed herein.

The sweeper roller 144 sweeps dry waste into the autonomous vacuum 100. The sweeper roller 144 generally comprises one or more brushes (e.g., comprising flexible bristles, flexible fins, or other sweeping extensions) attached to a cylindrical core. The sweeper roller 144 rotates to collect and clean messes. The sweeper roller 144 may be used to handle large particle messes, such as food spills or small items like plastic bottle caps. When the sweeper roller 144 is activated by the sweeper motor 146, the brushes act in concert to sweep dry waste towards a dry inlet connected to the dry channel 132. The brushes may be composed of a compliant material to sweep the dry waste. In some embodiments, the sweeper roller 144 may be composed of multiple materials for collecting a variety of waste, including synthetic bristle material, microfiber, wool, or felt.

The mop roller 148 mops the cleaning environment and ingests liquid waste into the autonomous vacuum 100. The mop roller 148 generally comprises fabric bristles or flexible loops attached to a cylindrical core. With the aid of a cleaning solution, the fabric bristles work to scrub away dirt, grease, or other contaminants that may have stuck to a cleaning surface (e.g., a surface to be cleaned). The mop motor 150 provides rotational force to the mop roller 148. In some embodiments, the mop roller 148 may be composed of multiple materials for collecting a variety of waste, including synthetic bristle material, microfiber, wool, or felt.

In normal sweeping mode, as the air flows from the dry channel 132 and the dry inlet towards the vacuum pump 120, the sweeper roller 144 rotates to move dry waste from the cleaning surface towards the inlet, in order to deposit the dry waste in the waste bag 112. In normal mopping mode, the cleaning head 140 sprays the cleaning solution (water, solvent, or solvent mixed with water) onto the cleaning environment or on top of the mop roller 148 itself. The mop roller 148 contacts the sprayed surface to scrub the surface with the fabric bristles. The vacuum force sucks up or ingests the liquid waste to deposit the liquid waste into the waste bag 112.

The side brush roller 154 sweeps dirt near a side of the cleaning head 140. The side brush roller 154 may rotate along an axis that is orthogonal or perpendicular to the ground. The side brush is controlled by a side brush motor 156. The side brush roller 154 may be shaped like a disk or a radial arrangement of bristles that can push dirt into the path of the sweeper roller 144. In some embodiments, the side brush roller 154 is composed of different materials than the sweeper roller 144 to handle different types of waste and mess. The side brush roller 154 may be concealed to minimize a profile of the cleaning head 140 when the side brush roller 154 is not in use.

The sprayer 152 sprays liquid into the cleaning environment. The sprayer 152 is connected to the liquid solution channel 134 that is connected to the solvent tank 114 and/or the water tank 116. A pump on the chassis 110 can dispense solvent and/or water from the solvent tank 114 and/or the water tank 116. The liquid travels to the sprayer 152, which then has a nozzle for spraying the liquid into the cleaning environment. The sprayer 152 may include a plurality of nozzles, e.g., two disposed on either side of the cleaning head 140.

The cleaning head 140 ingests waste 170 as the autonomous vacuum 100 cleans using the sweeper roller 144 and the side brush roller 154 and sends the waste 170 to the waste bag 112. The waste bag 112 collects and filters waste 170 from the air to send filtered air 175 out of the autonomous vacuum 100 through the vacuum pump 120 as air exhaust 180. The autonomous vacuum 100 may also use solvent 160 combined with pressure from the cleaning head 140 to clean a variety of surface types. The autonomous vacuum 100 may dispense solvent 160 from the solvent tank 114 onto an area to remove dirt, such as dust, stains, and solid waste and/or clean up liquid waste. The autonomous vacuum 100 may also dispense solvent 160 into a separate solvent tray, which may be part of a charging station (e.g., docking station 190), to clean the roller 144 and the side brush roller 154.

In other embodiments, any of the components of the autonomous vacuum can be variably distributed among the chassis 110, the connection assembly 130, and the cleaning head 140.

Figure 2:
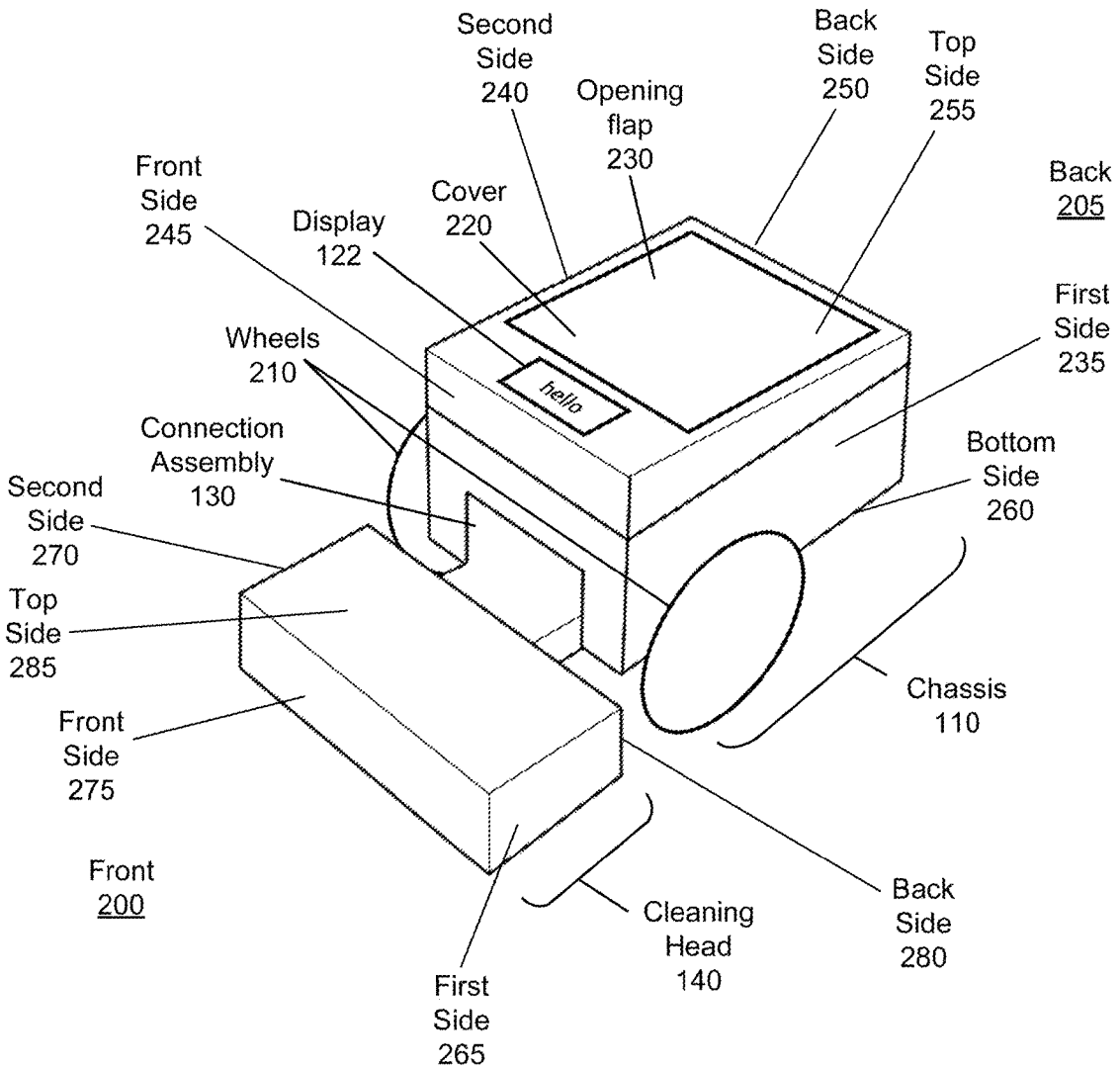
FIG. 2 illustrates a spatial arrangement of components of the autonomous vacuum, according to one example embodiment.

Referring now to FIG. 2, it illustrates a spatial arrangement of components of the autonomous vacuum 100, according to one example embodiment. The autonomous vacuum 100 includes the cleaning head 140 (as described in relation to FIG. 1) at the front 200 and the chassis 110 at the back 205. In one embodiment, the cleaning head 140 includes a first side 265 opposite a second side 270, a front side 275 opposite a back side 280, and a top side 285 opposite the floor surface. The back side 280 of the cleaning head 140 may be coupled to a front side of the chassis 110 via the connection assembly 130 (e.g., a four-bar linkage system). The connection assembly 130 may include and/or be connected to one or more actuators of the actuator assembly 138 such that the actuators can control movement of the cleaning head 140 with the four-bar linkage system.

The chassis 110 includes the frame, a plurality of wheels 210, a cover 220, an opening flap 230, and a display 122. The cover 220 is an enclosed hollow structure that covers containers internal to the base that contain solvent and waste (e.g., in the waste bag 112). In one embodiment, the cover of the chassis 110 and/or frame of the drive system includes a first side 235 opposite a second side 240, a front side 245 opposite a back side 250, and a top side 255 opposite a bottom side 260. The opening flap 230 may be opened or closed by a user to access the containers (e.g., to add more solvent, remove the waste bag 112, or put in a new waste bag 112). The cover may also house a subset of the sensors of the sensor system 118 and the actuator assembly 138, which may be configured at a front of the cover 220 to connect to the cleaning head 140. The display 122 is embedded in the cover 220 of the autonomous vacuum 100 and may include physical interface buttons and a touch sensitive interface.

Figure 3:
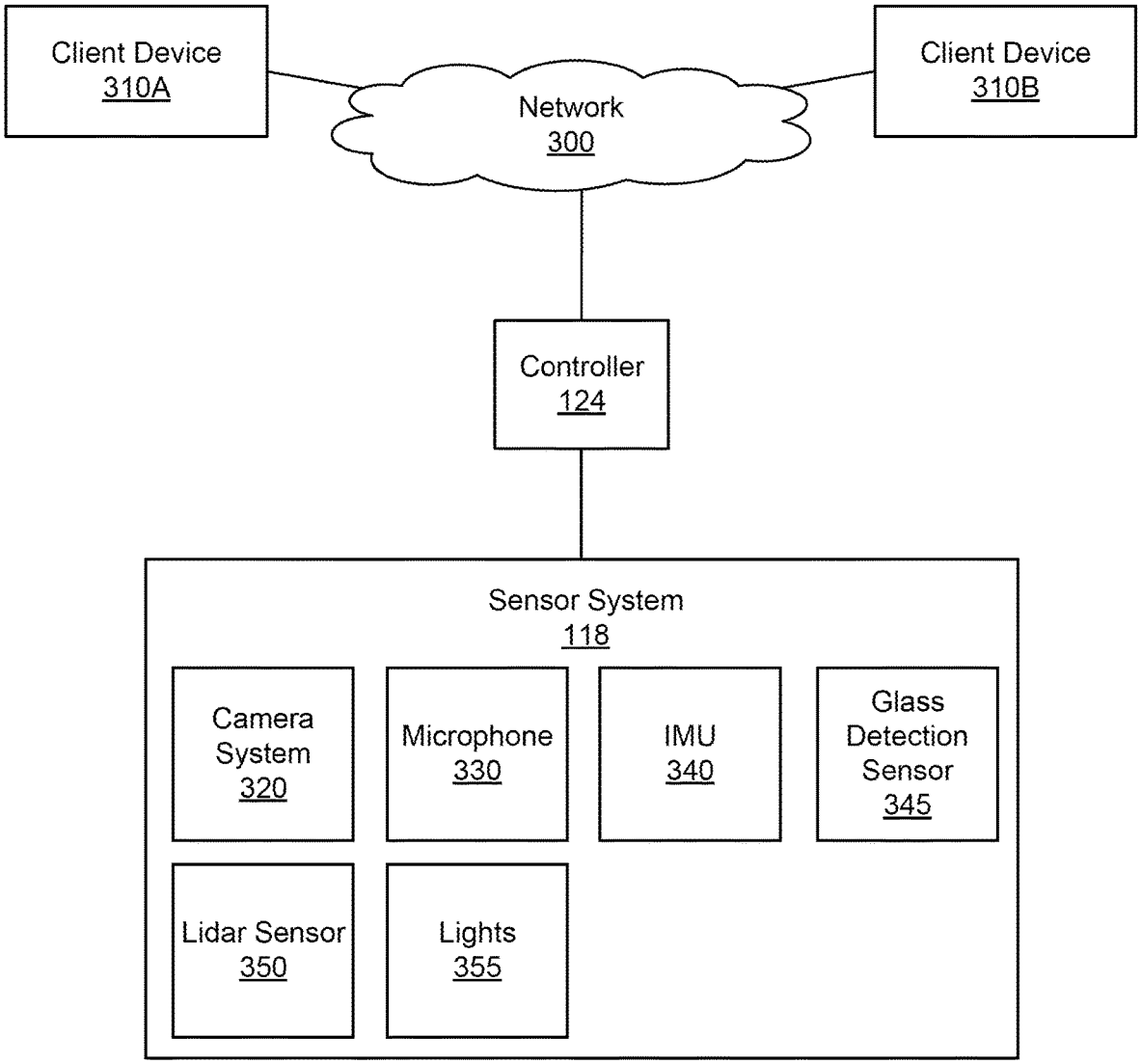
FIG. 3 is a block diagram of a sensor system of the autonomous vacuum, according to one example embodiment.

FIG. 3 is a block diagram of the sensor system 118 of the autonomous vacuum 100, according to one example embodiment. The sensor system 118 may receive sensor data from one or more cameras (video/visual), microphones 330 (audio), lidar sensors, infrared (IR) sensors, and/or inertial sensors that capture inertial data (e.g., environmental surrounding or environment sensor data) about an environment for cleaning. The sensor system 118 uses the sensor data to map the environment and determine and execute cleaning tasks to handle a variety of messes. The controller 124 manages operations of the sensor system 118 and its various components. The controller 124 may communicate with one or more client devices 310 via a network 300 to send sensor data, alert a user to messes, or receive cleaning tasks to add to a task list.

The network 300 may comprise any combination of local area and/or wide area networks, using wired and/or wireless communication systems. In one embodiment, the network 300 uses standard communications technologies and/or protocols. For example, the network 300 includes communication links using technologies such as Ethernet, 802.11 (WiFi), worldwide interoperability for microwave access (WiMAX), 3G, 4G, 5G, code division multiple access (CDMA), digital subscriber line (DSL), Bluetooth, Near Field Communication (NFC), Universal Serial Bus (USB), or any combination of protocols. In some embodiments, all or some of the communication links of the network 300 may be encrypted using any suitable technique or techniques.

The client device 310 is a computing device capable of receiving user input as well as transmitting and/or receiving data via the network 300. Though only two client devices 310 are shown in FIG. 3 (i.e., 310A and 310B), in some embodiments, more or fewer client devices 310 may be connected to the autonomous vacuum 100. In one embodiment, a client device 310 is a conventional computer system, such as a desktop or a laptop computer. Alternatively, a client device 310 may be a device having computer functionality, such as a personal digital assistant (PDA), a mobile telephone, a smartphone, a tablet, an Internet of Things (IoT) device, or another suitable device. A client device 310 is configured to communicate via the network 300. In one embodiment, a client device 310 executes an application allowing a user of the client device 310 to interact with the sensor system 118 to view sensor data, receive alerts, set cleaning settings, and add cleaning tasks to a task list for the autonomous vacuum 100 to complete, among other interactions. For example, a client device 310 executes a browser application with an application programming interface (API) that enables interactions between the client device 310 and the autonomous vacuum 100 via the network 300. In another embodiment, a client device 310 interacts with autonomous vacuum 100 through an application running on a native operating system of the client device 310, such as iOS® or ANDROID™.

In some embodiments, the sensor system 118 includes a camera system 320, microphone 330, inertial measurement device (IMU) 340, a glass detection sensor 345, a lidar sensor 350, and lights 355.

The camera system 320 comprises one or more cameras that capture visual data about the environment (e.g., in the form of images and/or video signals). In some embodiments, the camera system 320 includes an IMU (separate from the IMU 340 of the sensor system 118) for capturing visual-inertial data in conjunction with the cameras. The visual data captured by the camera system 320 may be used for image processing.

The microphone 330 captures audio data by converting sound into electrical signals that can be stored or processed by other components of the sensor system 118. The audio data may be processed to identify voice commands for controlling functions of the autonomous vacuum 100. In one embodiment, sensor system 118 uses more than one microphone 330, such as an array of microphones.

The IMU 340 captures inertial data describing the autonomous vacuum's 100 force, angular rate, and orientation. The IMU 340 may include one or more accelerometers, gyroscopes, and/or magnetometers. In some embodiments, the sensor system 118 employs multiple IMUs 340 to capture a range of inertial data that can be combined to determine a more precise measurement of the autonomous vacuum's 100 position in the environment.

The glass detection sensor 345 detects glass in the environment. Glass may be transparent material that may be stained, leaded, laminate or the like and may be part of furniture, flooring, or other objects in the environment (e.g., cups, mirrors, candlesticks, etc.). The glass detection sensor 345 may be an infrared sensor and/or an ultrasound sensor. In some embodiments, the glass detection sensor 345 is coupled with the camera system 320 to remove glare from the visual data when glass is detected. For example, the camera system 320 may have integrated polarizing filters that can be applied to the cameras of the camera system 320 to remove glare. In some embodiments, the glass sensor is a combination of an IR sensor and neural network that determines if an obstacle in the environment is transparent (e.g., glass) or opaque.

The lidar sensor 350 emits pulsed light into the environment and detects reflections of the pulsed light on objects (e.g., obstacles or obstructions) in the environment. Lidar data captured by the lidar sensor 350 may be used to determine a 3D representation of the environment.

The lights 355 are one or more illumination sources that may be used by the autonomous vacuum 100 to illuminate an area around the autonomous vacuum 100. In some embodiments, the lights may be LEDs, e.g., having a static color such as white or green, or changeable colors (such as green of operating, red for stopped and yellow indicating slowing down).

Example Magnetic Independent Ground Interaction

The actuator assembly 138 may move the cleaning head into a first sweeping (or patrolling) position and into a second mopping position. In particular, the cleaning head 140 and connection assembly 130 are configured such that a four-bar linkage system and pivot axis connect the cleaning head 140 to the baseplate, permitting for limited vertical and tilting motions of the cleaning head 140. This arrangement means that during sweeping, if the autonomous vacuum 100 moves forward, the forces on the cleaning head can cause it to pitch backward and forward between a mopping and a sweeping position. The arrangement also makes mopping difficult because the cleaning head 140 pitches when moved backward and forward, instead of performing a scrubbing motion.

One or more pairs of magnets are used to counteract this issue. With one magnet attached to the baseplate of the chassis 110, and another magnet attached to the back tube of the cleaning head 140, the cleaning head can be magnetically secured in place during mopping operation. This configuration keeps the mop roller 148 exposed to the floor surface when the autonomous vacuum 100 moves forward and backward during mopping, enabling scrubbing motions for improved cleaning of stubborn debris and stains that may be stuck to the floor.

Figure 4:
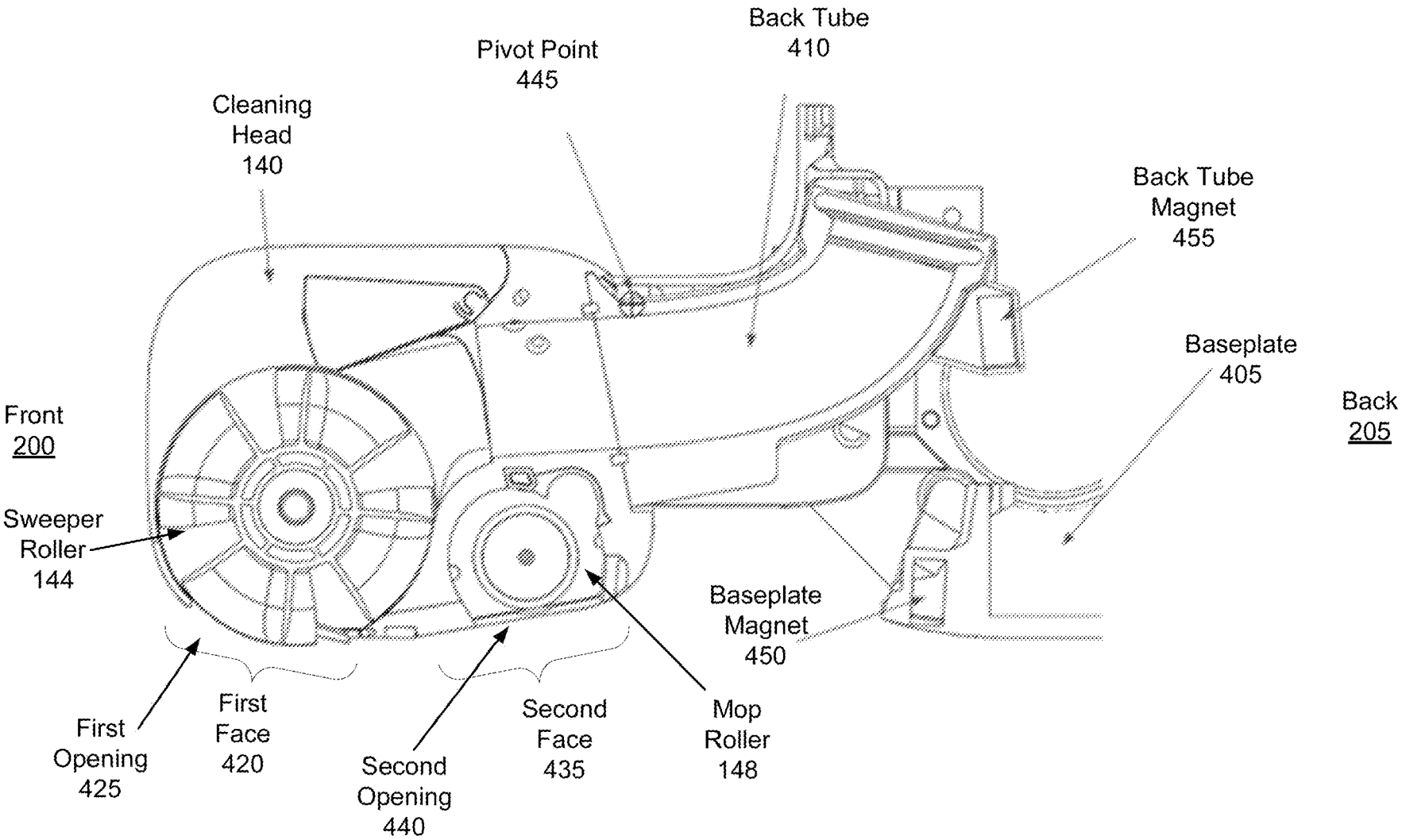
FIG. 4 illustrates a side view of the cleaning head and its attachment to the chassis of the autonomous vacuum, in accordance with an example embodiment.

FIG. 4 illustrates a side view of the cleaning head 140 and its attachment to the chassis 110 of the autonomous vacuum 100, in accordance with an example embodiment. The cleaning head 140 includes the sweeper roller 144 and the mop roller 148. A bottom side of the cleaning head 140 comprises two faces that converge at an obtuse angle. The first face 420 includes a first opening 425 through which the sweeper roller 144 is to the floor surface. In one embodiment, the first opening 425 extends across the first face 420 from the first side 265 of the cleaning head 140 to the second side 270 of the cleaning head 140. The second face 435 includes a second opening 440 through which the mop roller 148 is exposed to the floor surface. In one embodiment, the second opening 440 extends across the second face 435 from the first side 265 of the cleaning head 140 to the second side 270 of the cleaning head 140. The first face 420 and second face 435 may be angled away from each other to allow either the sweeper roller 144 or the mop roller 148 to engage with the floor without having both rollers exposed to the floor surface simultaneously.

The cleaning head 140 may include a pivot point 445. The pivot point 445 is a point around which the cleaning head 140 will rotationally pivot due to the weight of the cleaning head 140 components and the back tube 410 and due to frictional forces that the cleaning head encounters when it engages with the floor surface. When the cleaning head 140 is pitched forward around the pivot point 445, the first face 420 is substantially parallel to the floor surface, engaging the sweeper roller 144 with the floor surface. When the cleaning head 140 is pitched backward around the pivot point 445, the second face 435 is substantially parallel to the floor surface, engaging the mop roller 148 with the floor surface. In some embodiments, one of the four-bar linkages in the connection assembly 130 includes a pin assembly extending from the first side 265 to the second side 270 of the cleaning head at the pivot point 445, and the cleaning head may pitch around the pin assembly. When the cleaning head 140 is pitching backward and forward around the pivot point, it encounters a hard stop against one of the four-bar linkages in each direction, causing the forward or backward pitch to stop.

In some embodiments, the back tube may include wires, water tubes, snorkel ducts, sweeping ducts, and pressure tubes that extend through the back tube and connect the components of the cleaning head 140 with components in the drive system and chassis 110. In some embodiments, the wires, water tubes, sweeping ducts, snorkel ducts, and pressure tubes are positioned such that they add beneficial resistance to the motion of the cleaning head about the pivot point.

One or more back tube magnets 455 are attached to the exterior of the back tube 410 at the back side of the cleaning head 140. In some embodiments, the back tube magnet 455 may alternately be attached to the back side 280 of the cleaning head 140. For this reason, the back tube magnets 455 may also be referred to as "cleaning head magnets." One or more base-plate magnets 450 are attached to the baseplate 405 of the chassis 110. The back tube magnets 455 are positioned such that they align with corresponding base-plate magnets 450. In some embodiments, the magnet surfaces may have friction and abrasion reducing coatings, films, or thin enclosures to protect the magnets and to help with component interactions. The magnets may additionally be structured in any appropriate shape, material composition, and magnetic pole arrangements to satisfy force and motion requirements associated with securing the cleaning head 140 into a mopping position. The magnets are positioned such that when the cleaning head 140 is pitched forward in the sweeping position, the pole of a back tube magnet 455 and the pole of the corresponding base-plate magnet 450 are not within a range to cause the magnetic force to secure the two magnets together. However, when the cleaning head 140 is pitched backward in the mopping position, the pole of the back tube magnet 455 is within range of the pole of the corresponding base-plate magnet 450 and the magnetic force will secure the magnets together. The magnets may be configured such that they are secured together using a magnetic adhesion force and/or a magnetic shear force. In some embodiments the force securing the cleaning head into a mopping position may be primarily the magnetic shear force or may be the magnetic adhesion force.

At sweeping and patrolling heights of the cleaning head 140, the location of the back tube magnet 455 in relation to the baseplate magnet 405 is such that the magnets do not get close enough for their poles to significantly attract via a magnetic force. However, during a mopping state, the cleaning head 140 is lowered within a ranch such that when the cleaning head 140 first pitches back, the attractive pole of the back tube magnet 455 becomes close enough to the corresponding attractive pole of the baseplate magnet 450 for the magnetic force to firmly attract the magnets together. This magnetic force thus secures the cleaning head 140 into the pitched back mopping position, with some tolerance for changing height in the case of an uneven floor surface. The back tube magnet 455 and baseplate magnet 405 can be pulled apart from one another by the force of the actuator assembly 138 raising the cleaning head 140 into the sweeping state position so that the magnets are no longer close enough to attract each other. That is, the back tube magnets 455 and base plate magnets 405 are positioned to be able to disengage by retraction of the actuator assembly 138. Additional information about the back tube magnet 455, the baseplate magnet 450, and the movement of the cleaning head 140 is included in the descriptions for FIG. 6 and FIG. 7.

Figure 5:
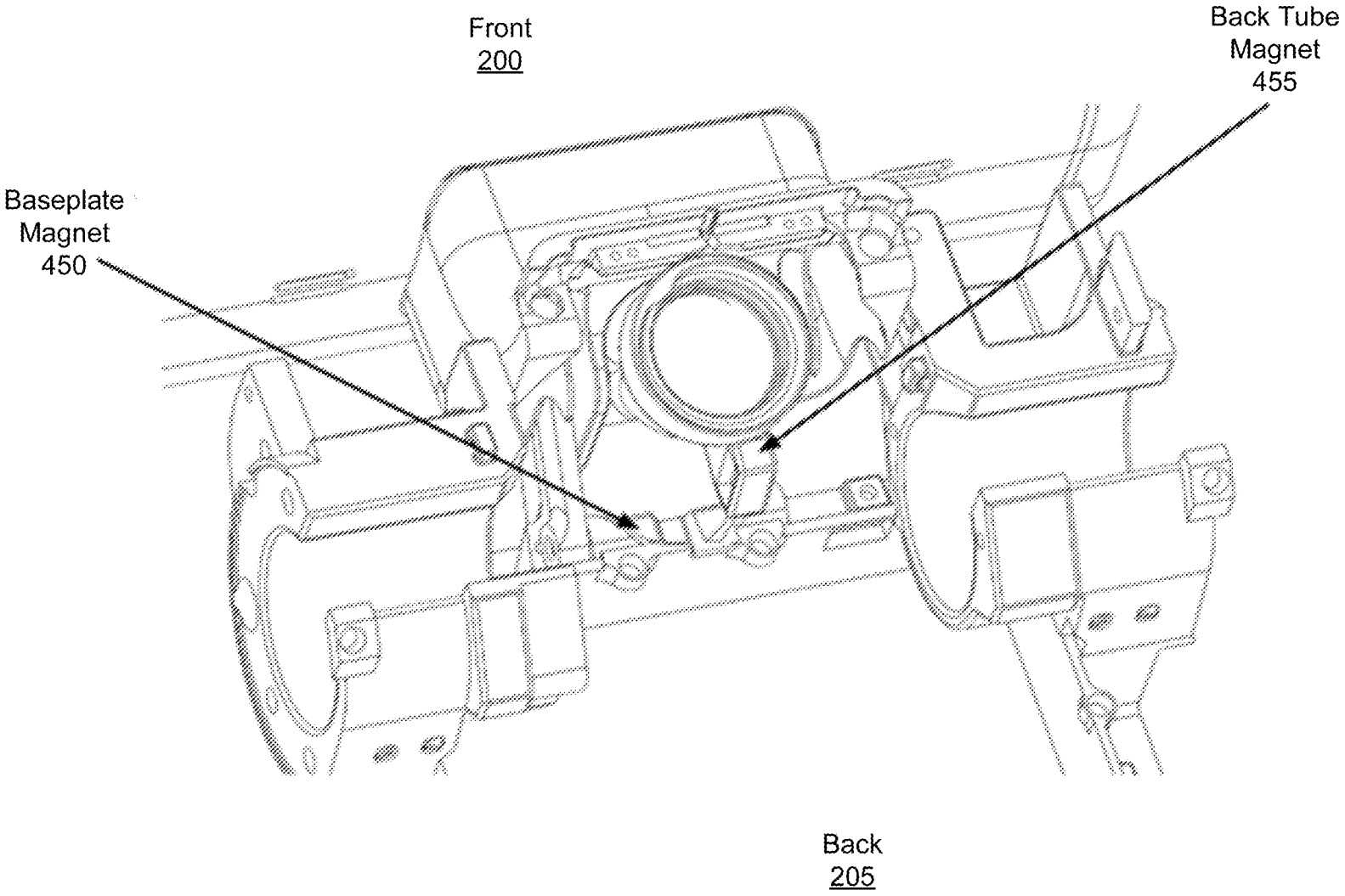
FIG. 5 is angled view of the top side and back side of the cleaning head, in accordance with an example embodiment.

FIG. 5 is angled view of the top side and back side of the cleaning head 140, in accordance with an example embodiment. The view illustrates the placement of the baseplate magnet 450, which may be rigidly attached to the baseplate 405 of the chassis 110. The baseplate magnet 450 is exposed at the front of the chassis 110 and is oriented such that an attracting pole faces substantially upward. The corresponding back tube magnet 455 is rigidly attached to the back tube 410 of the cleaning head 140. The back tube magnet 455 is exposed at the back exterior side of the back tube 410 and is oriented such that an attracting pole corresponding to the attracting pole of the baseplate magnet 450 faces substantially downward and aligns with the attracting pole of the baseplate magnet 450.

Figure 6:
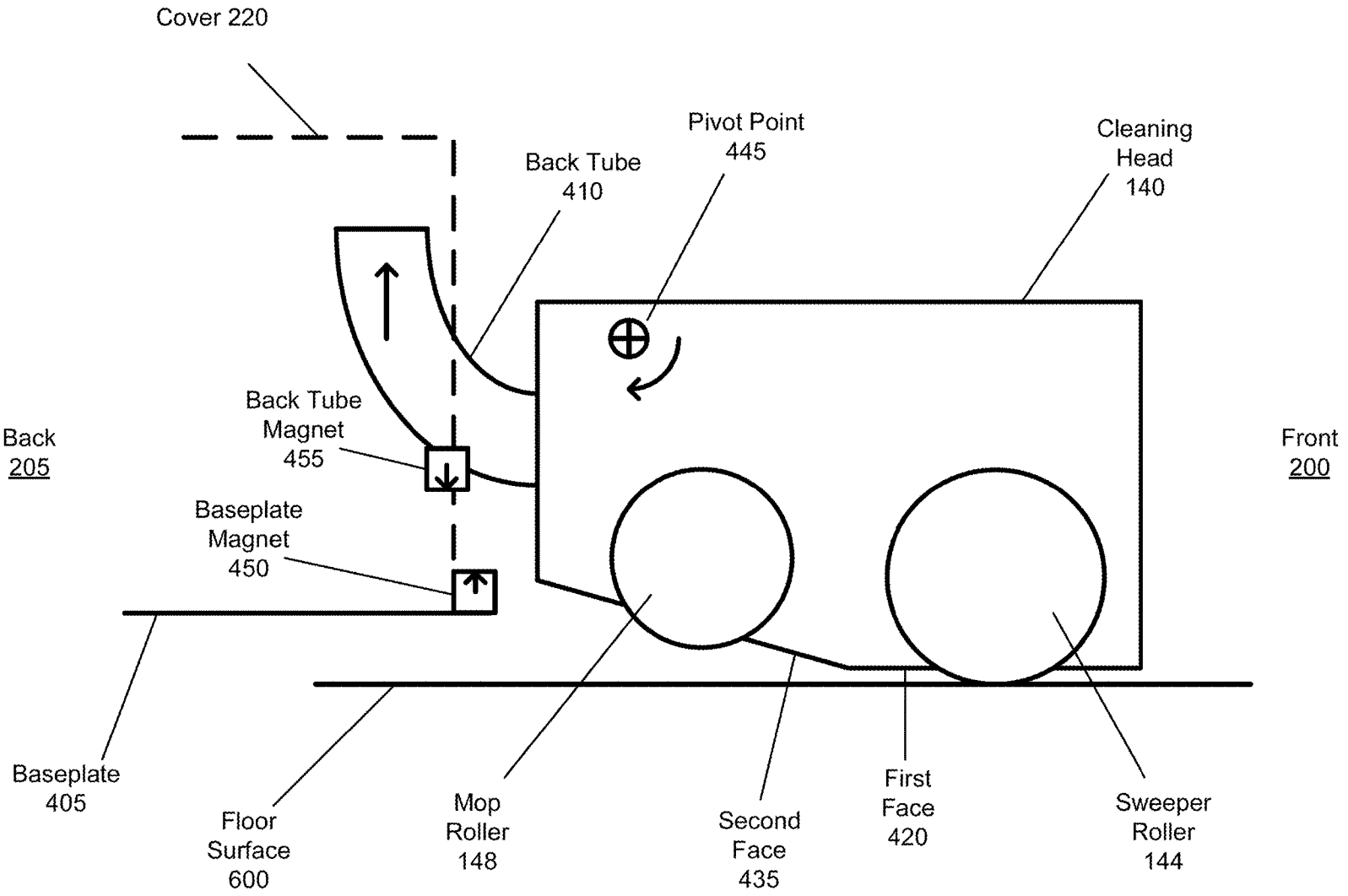
FIG. 6 is a diagram illustrating components of the autonomous vacuum in a first sweeping state, in accordance with an example embodiment.

FIG. 6 is a diagram illustrating components of the autonomous vacuum 100 in a first sweeping state, in accordance with an example embodiment. The cleaning head 140 of the autonomous vacuum may be raised vertically by the actuator assembly 148 (e.g., by winding a cable) when the autonomous vacuum 100 is performing sweeping or patrolling actions in an environment. Raising the back tube 410 of the cleaning head 140 causes the cleaning head 140 to pitch or rotate forward around the pivot point 445 such that the first face 420 of the cleaning head 140 is substantially parallel to the floor surface 600 and the sweeper roller 144 is exposed to the floor surface 600. The cleaning head 140 may be pitched forward due to the weight of the internal components and/or due to the frictional forces of moving the cleaning head forward along the floor surface 600.

The pivot point 445 shown in the diagram of FIG. 6 represents a position around which the components of the cleaning head 140 tend to rotate due to the distribution of mass in the various components. In some embodiments, the pivot point 445 may be an axle attached at one or both ends to the chassis 110 around which the cleaning head 140 may pivot.

The back tube magnet 455 and the baseplate magnet 450 are positioned such that, in a raised position (e.g., a height associated with a first sweeping or patrolling state), the back tube magnet 455 and the baseplate magnet 450 do not come close enough together for the magnetic force between them to cause the magnets to engage with one another.

Figure 7:
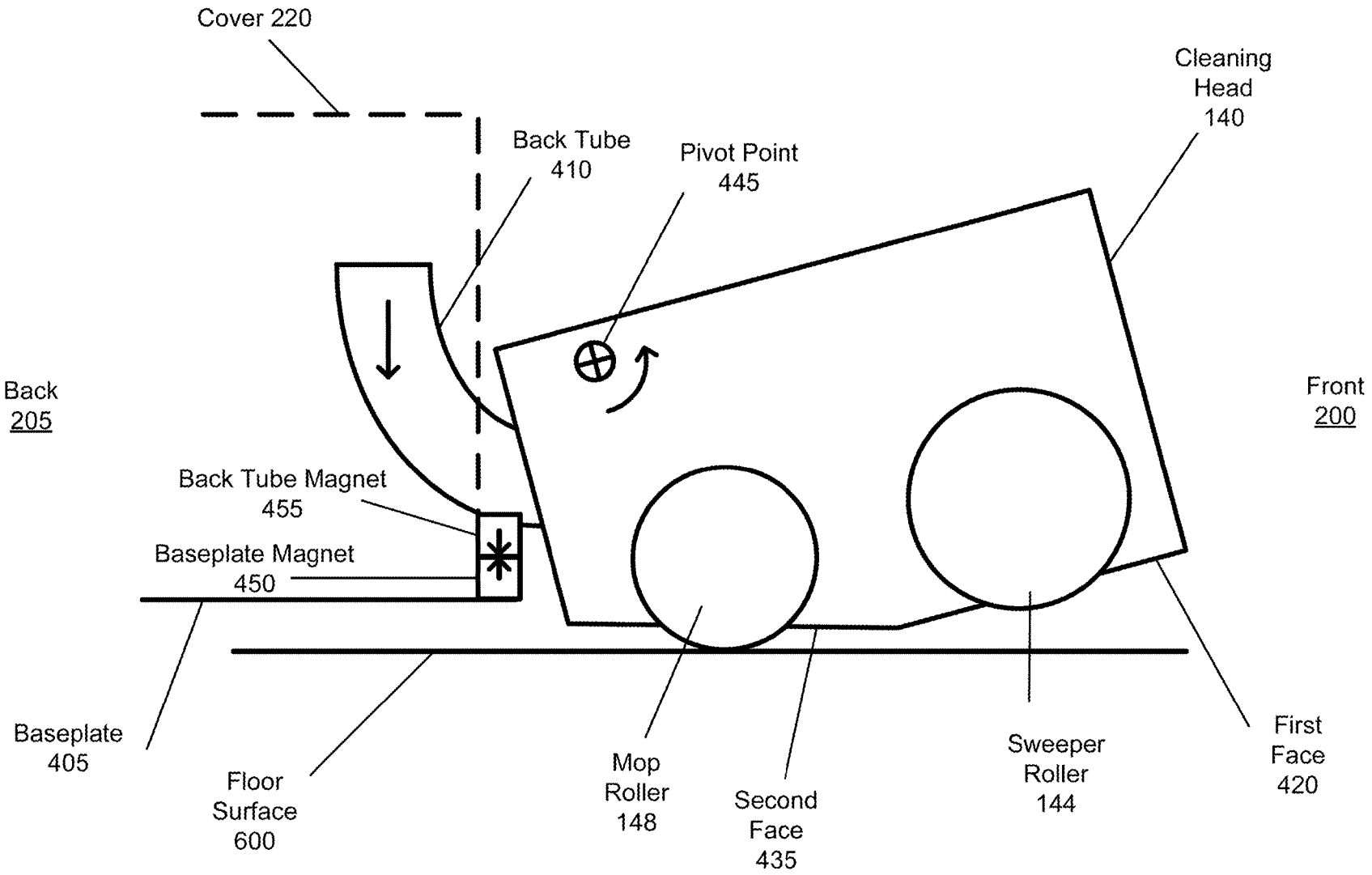
FIG. 7 is a diagram illustrating components of the autonomous vacuum in a second mopping state, in accordance with an example embodiment.

FIG. 7 is a diagram illustrating components of the autonomous vacuum 100 in a second mopping state, in accordance with an example embodiment. The cleaning head 140 of the autonomous vacuum 100 may be lowered vertically by the actuator assembly 148 (e.g., by unwinding or winding a cable that may be wrapped around a spool). At cleaning head 140 heights associated with mopping, forward movement of the autonomous vacuum 100 by the drive system initiates pitching of the cleaning head 140 backward around the pivot point 445. The pitching of the cleaning head 140 may be caused by frictional forces between the cleaning head 140 and the floor surface 600.

The back tube magnet 455 and the baseplate magnet 450 are positioned such that when the cleaning head 140 is lowered into a mopping position and pitched backward, the magnet surfaces come close enough to each other to attract with sufficient magnetic force to secure together. The baseplate magnet 450 and the back tube magnet 455 are attracted together with enough magnetic force to sufficiently hold the baseplate 405 of the drive system and the cleaning head 140 together during mopping operations. Locking the cleaning head 140 into the pitched back position with the magnets makes it possible for the autonomous vacuum 100 to move forward and backward over the floor surface 600 without the frictional forces causing the cleaning head 140 to pitch with each movement. Locking the cleaning head into the mopping position thus allows the autonomous vacuum 100 to perform scrubbing actions with the mopper rather than only allowing mopping in a forward direction.

The back tube magnet 455 and the baseplate magnet 450 have a strong enough magnetic attraction to hold the cleaning head 140 in place during mopping operations. in one example embodiment, the weight from the cleaning head 140, spring extension of the duct, normal contact with the floor, and the frictional sliding between the cleaning head 140 and the floor surface all impart forces on the cleaning head during operation. Therefore, the minimum attractive force from the back tube magnet 455 to the baseplate magnet 450 in the direction of movement (e.g., rotation around the cleaning head pivot which creates a shear movement between the magnets) must be sufficient to overcome the forces from the other components in the system. At the same time, the magnetic attraction between the back tube magnet 455 and the baseplate magnet 450 is weak enough that can be disengaged to separate the magnets by the force of the actuator assembly 138 raising the back tube 410 into the higher sweeping position. In one example embodiment, the actuator assembly 138 pulls upwards on the system to release the back tube magnet 455 from the latched (i.e., magnetically secured) position to return to a sweeping position. The ability to hold the back tube magnet 455 in the latched position with the baseplate magnet 450 defines the lower bound of acceptable magnet forces. The force provided by the actuator system 138 to switch out of the mopping position defines the upper bound of acceptable magnet force. The magnet force in the system must be selected between these two limits, in one embodiment, the system's nominal latching magnet has a maximum shear attraction force of 900 grams.

Figure 8:
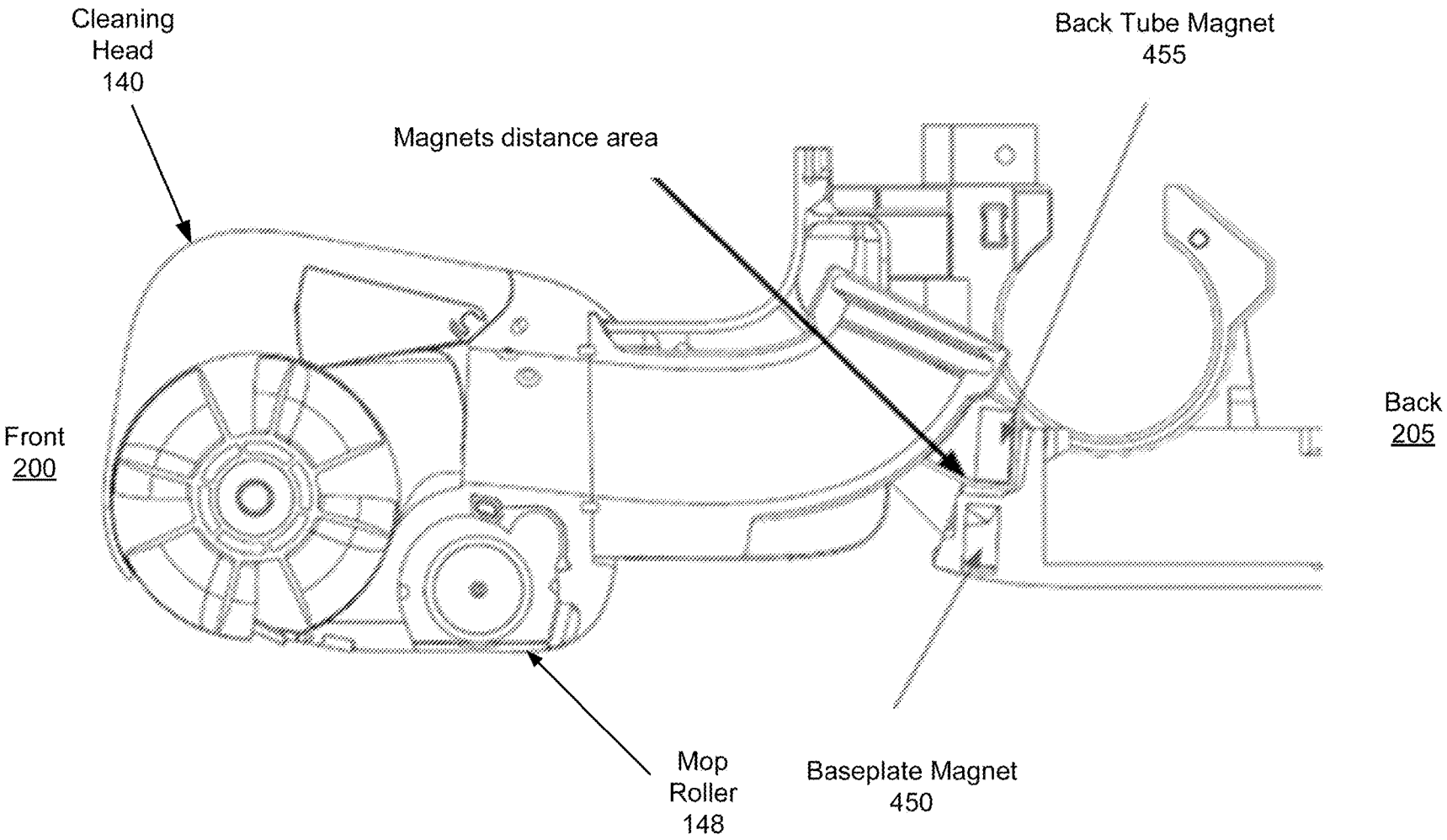
FIG. 8 is a side view illustration of the cleaning head showing magnet positioning when the cleaning head is in a sweeping state, in accordance with an example embodiment.

FIG. 8 is a side view illustration of the cleaning head 140 showing magnet positioning when the cleaning head 140 is in a sweeping state, in accordance with an example embodiment. The baseplate magnet 450 and the back tube magnet 455 are not positioned close enough for the poles to be secured together by the magnetic force when the cleaning head 140 is in the raised sweeping state position. Accordingly, given the distance between the magnetic poles of the baseplate magnet 450 and back tube magnet 455, the magnetic field is insufficient to draw the magnets 450, 455 together and, in turn, adjust the position of the cleaning head 140 to the sweeping state.

Figure 9:
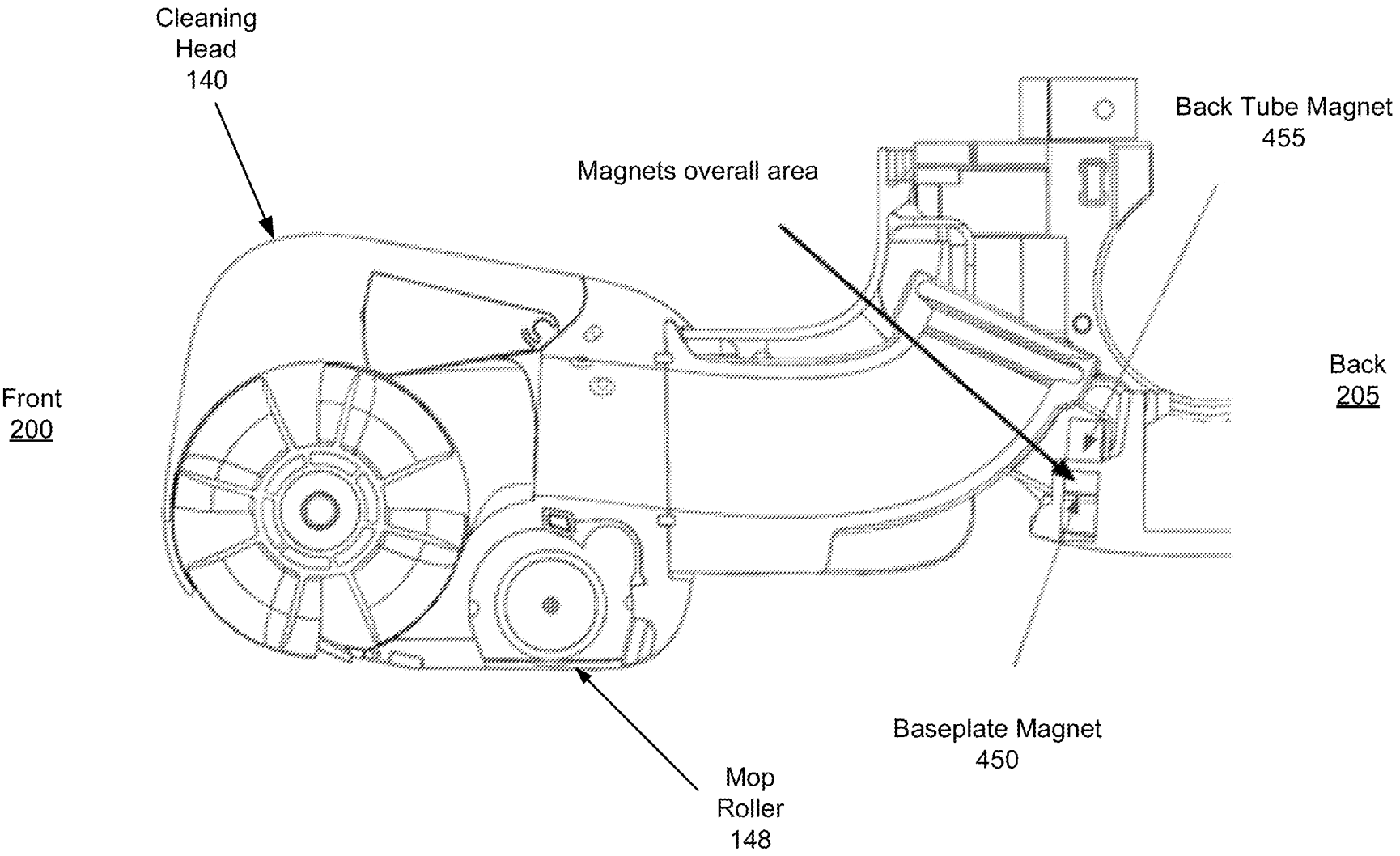
FIG. 9 is a side view illustration of the cleaning head showing magnet positioning when the cleaning head is in a mopping state, in accordance with an example embodiment.

FIG. 9 is a side view illustration of the cleaning head 140 showing magnet positioning when the cleaning head 140 is in a mopping state, in accordance with an example embodiment. The baseplate magnet 450 and the back tube magnet 455 are positioned such that in the lowered mopping state position, the poles of the magnets will align and be close enough to secure together via the attractive magnetic force between them. Accordingly, the distance between the magnetic poles of the baseplate magnet 450 and back tube magnet 455 the magnetic field is now sufficiently large to bring the magnets 450, 455 together and, in turn, adjust and secure the position of the cleaning head 140 to the mopping state.

Snorkel Ducts

The autonomous vacuum 100 includes a sweeping system and a mopping system, both packaged in the cleaning head 140. The sweeping system ingests mostly air and dry waste, e.g., debris (often fine debris particles like dust). The mopping system ingests mostly air and liquids waste (e.g., dirty water, used cleaning solutions). Issues may arise when both the dry debris and fluids travel up the same duct from the cleaning head 140 to the waste bag 112.

First, the different types of waste require different power settings and intake configurations to be efficiently moved from the floor surface 600 to the waste bag 112. Fluid from the cleaning head 140 mop roller 148 is primarily carried upstream along the walls of a duct in thin films by way of viscous drag created by flowing air. Carrying fluid in this way with a system that uses one duct to remove both dry and wet debris requires high air velocities, high vacuum speed settings, which are noisy and lead to large power draws. Additionally, ducts for removing dry waste are often designed to be extendible and have coarse internal features that can prevent the airflow from easily moving fluids to the waste bag 112. These same features may also retain fluids and allow them to dribble back down to the cleaning head 140 when the vacuum 100 is not in use.

Secondly, removal of fluids during mopping can cause the removal ducts to become damp. If dry debris from a sweeping system interacts with fluids collected during mopping, a slurry may form within the duct, which can cause clogs.

It is therefore advantageous to split the streams of wet and dry debris during the suction process. In some embodiments the wet and dry debris are later recombined in a single waste bag 112.

Figure 10:
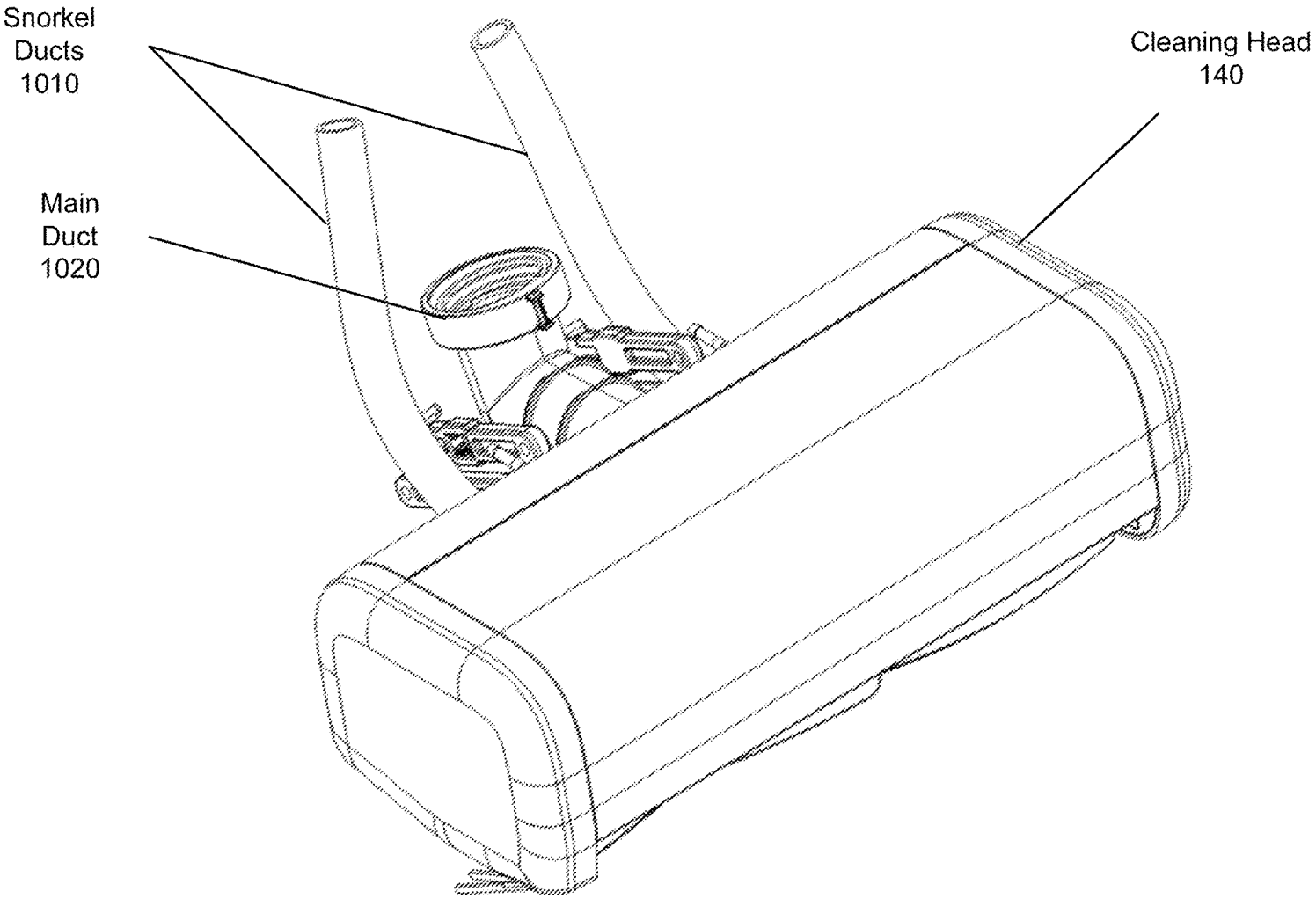
FIG. 10 is an angled top side view of the cleaning head of the autonomous vacuum 100 illustrating snorkel ducts, in accordance with an example embodiment.

FIG. 10 is an angled top side view of the cleaning head 140 of the autonomous vacuum 100 illustrating snorkel ducts, in accordance with an example embodiment. FIG. 10 shows the cleaning head 140, the main duct 1020, and two snorkel ducts 1010. The main duct 1020 extends from the back of the cleaning head 140, and is configured to accept dry debris collected at the sweeper roller 144 and to transport the dry debris via a suction system to the waste bag 112. The autonomous vacuum 100 also includes one or more snorkel ducts 1010. The snorkel ducts 1010 extend from the back of the cleaning head 140, and are configured to accept wet debris and/or fluids from the mop roller 148. The snorkel ducts 1010 are used to transport the wet debris and fluids via a suction system to the waste bag 112.

The snorkel ducts 1010 may be one or more flexible elastomeric tubes with smooth walls. The snorkel ducts 1010 are sized and routed such that they can kink to collapse the cross section, blocking fluid intake when the cleaning head 140 is in a state that is not associated with mopping operations. In some embodiments, the total cross section of the snorkel ducts 1010 is smaller than the cross section of the main duct 1020. This sizing increases air velocities within the snorkel ducts 1010, thus also increasing drag on the water films inside the snorkel ducts 1010. Higher drag on the water films within the snorkel ducts makes it possible for lower vacuum speeds (and thus a lower power draw) to be used to move the fluids up to the waste bag 112.

In one embodiment, the snorkel system is architected with two snorkel ducts 1010 that are separate from the main duct 1020. The ratio of the main duct 1020 inner diameter to the snorkel duct 1010 inner diameter is in the range of 10:1 to 1:1. The snorkel ducts 1010 comprise flexible elastomeric tubes with inner diameters in the range of 4 millimeters (mm) to 25 mm and an inner diameter to wall thickness ratio in the range of 1:1 to 1:25. The snorkel ducts 1010 may have smooth walls in some embodiments, and in some cases, the snorkel ducts 1010 may be positioned to include one or more tight (Zero-bend radius) turns along the path of the wet debris. The dimensioning and routing of the snorkel ducts 1010 are designed such that specific actuation motion by the autonomous vacuum 100 (e.g., raising of the cleaning head 140) initiates kinking in at least one location on each snorkel duct 1010, blocking or partially blocking the duct opening to prevent suction of dry debris into the snorkel ducts 1010 during sweeping operations. In some embodiments, there may be faces, edges, and/or points proximate to the snorkel ducts 1010 that are positioned to help initiate kinking of the snorkel ducts 1010 when the cleaning head is raised into a sweeping position.

Figure 11:
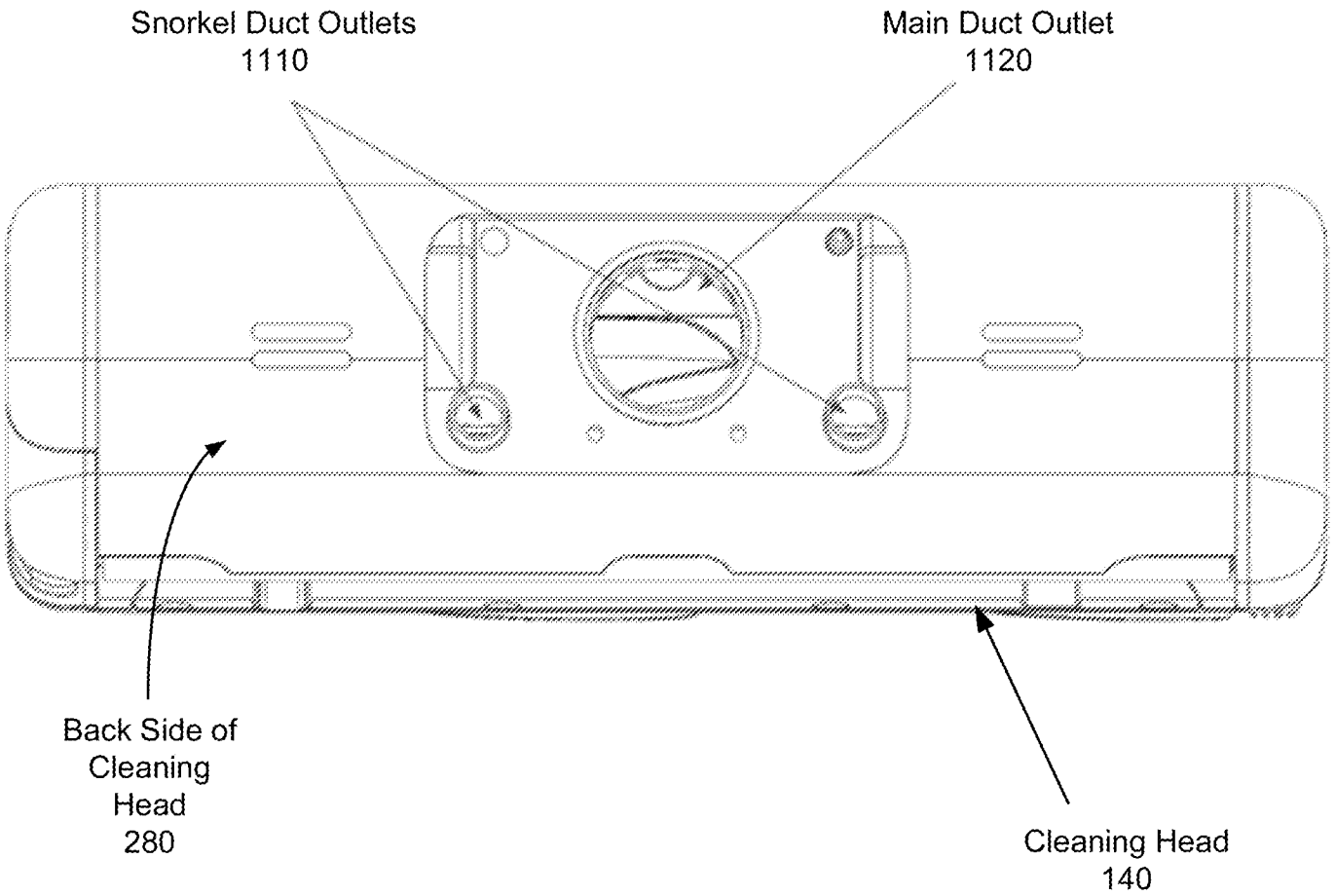
FIG. 11 is a back view of the cleaning head, according to one example embodiment.

FIG. 11 is a back view of the cleaning head 140. In one embodiment, the back side 280 of the cleaning head 140 includes the snorkel duct outlets 1110 and the main duct outlet 1120. The main duct outlet 1120 is an opening configured to connect a first end of the main duct 1020 to the cleaning head 140. The main duct outlet 1120 opens into the sweeper roller 144, facilitating suction and transfer of dry debris and materials from the sweeper roller 144, through the main duct 1120, and to the waste bag 112. The back side 280 of the cleaning head 140 also includes one or more snorkel duct outlets 1110. The snorkel duct outlets 1110 are openings configured to connect first ends of the snorkel ducts 1010 to the cleaning head 140. The snorkel duct outlets 1110 open into the mop roller 148 portion of the cleaning head 140, facilitating suction and transfer of fluids from the mop roller 148, through the snorkel ducts 1010 and to the waste bag 112.

Figure 12:
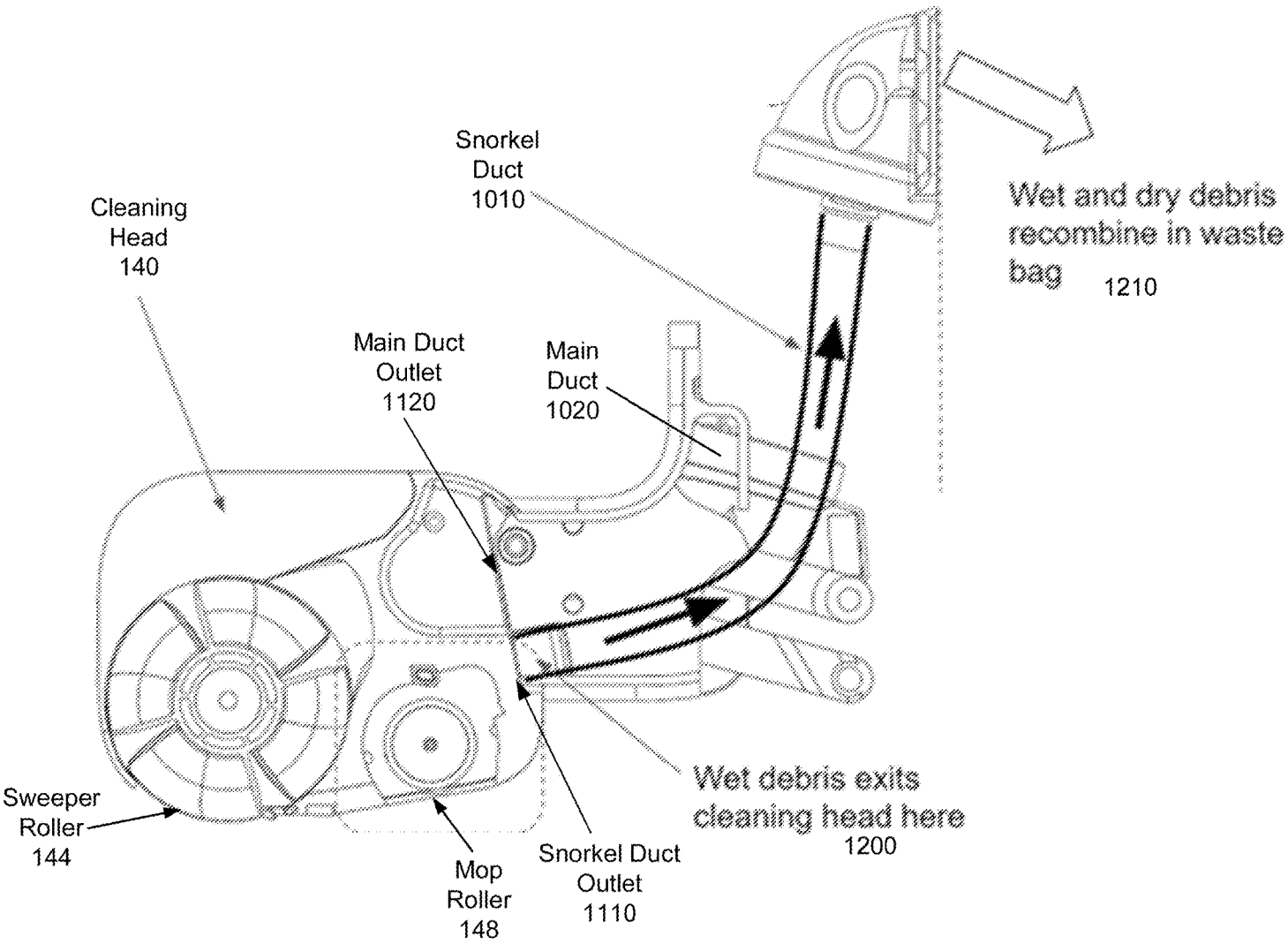
FIG. 12 is a side view of the cleaning head showing a snorkel duct during mopping operation, according to one example embodiment.

FIG. 12 is a side view of the cleaning head 140 showing a snorkel duct 1010 during mopping operation. When the cleaning head 140 is lowered into a mopping position and secured by the attraction of the baseplate magnet 450 and back tube magnet 455, the snorkel duct 1010 is open and fluid can flow unimpeded through the snorkel duct to the waste bag 112. The snorkel duct 1010 is dynamically affected by the vertical deflections and movements of the cleaning head 140 when it transitions from a sweeping state to a mopping state. When the cleaning head 140 with the magnet system moves up and down, it causes concurrent movements in the snorkel ducts 1010 and may cause the snorkel duct 1010 to kink open or shut. The snorkel duct 1010 is dimensioned such that the cross section is 50% to 100% open during mopping operations. The wet debris exits 1200 the mop roller 148 is transmitted along the snorkel duct 1010, and may be recombined 1210 with other collected debris, fluids, and particles in the waste bag 112.

Figure 13:
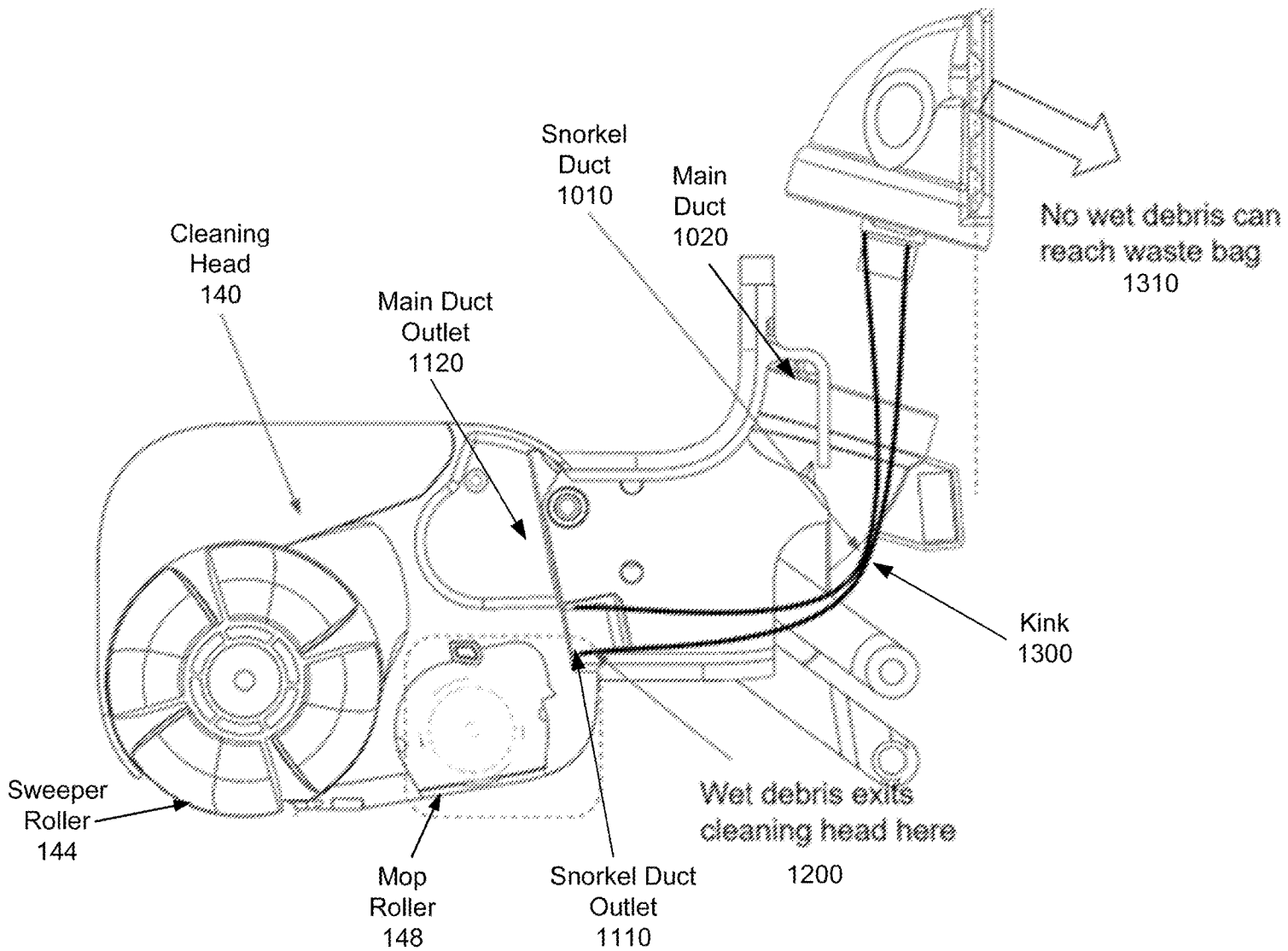
FIG. 13 is a side view of the cleaning head 140 showing a snorkel duct during sweeping or patrolling operations, according to one example embodiment.

FIG. 13 is a side view of the cleaning head 140 showing a snorkel duct 1010 during sweeping or patrolling operations. As with the action of lowering the cleaning head 140, raising the cleaning head 140 into a sweeping position by disengaging the attraction between the baseplate magnet 450 and the back tube magnet 455 that secure the cleaning head 140 in the mopping position affects the cross-sectional area of the snorkel duct 1010. In particular, raising the cleaning head 140 into a sweeping position causes the snorkel duct 1010 to become kinked 1300. When the snorkel duct 1010 is kinked, some wet debris may exit the cleaning head 1200, but will not reach 1310 the waste bag 112 because the kink fully or partially blocks the path of air and debris and prevents suction through the snorkel duct 1010. The snorkel duct 1010 is dimensioned such that a kink 1300 reduces the open cross-sectional area by 50% to 100%. In some embodiments, there may be faces, edges, and/or points proximate to the snorkel ducts 1010 that are positioned to help initiate kinking of the snorkel ducts 1010.

Mop System Cleaning Logic

The autonomous vacuum 100 includes cleaning logic routines that control the mop roller saturation levels and detect issues with various rotary components such as the mop roller 148, the side brush roller 154, and the sweeper roller 144. Within routines, sensor data obtained by the sensor system 118 may be periodically or continuously interpreted to determine a best next course of action for the autonomous vacuum 100.

Figure 14:
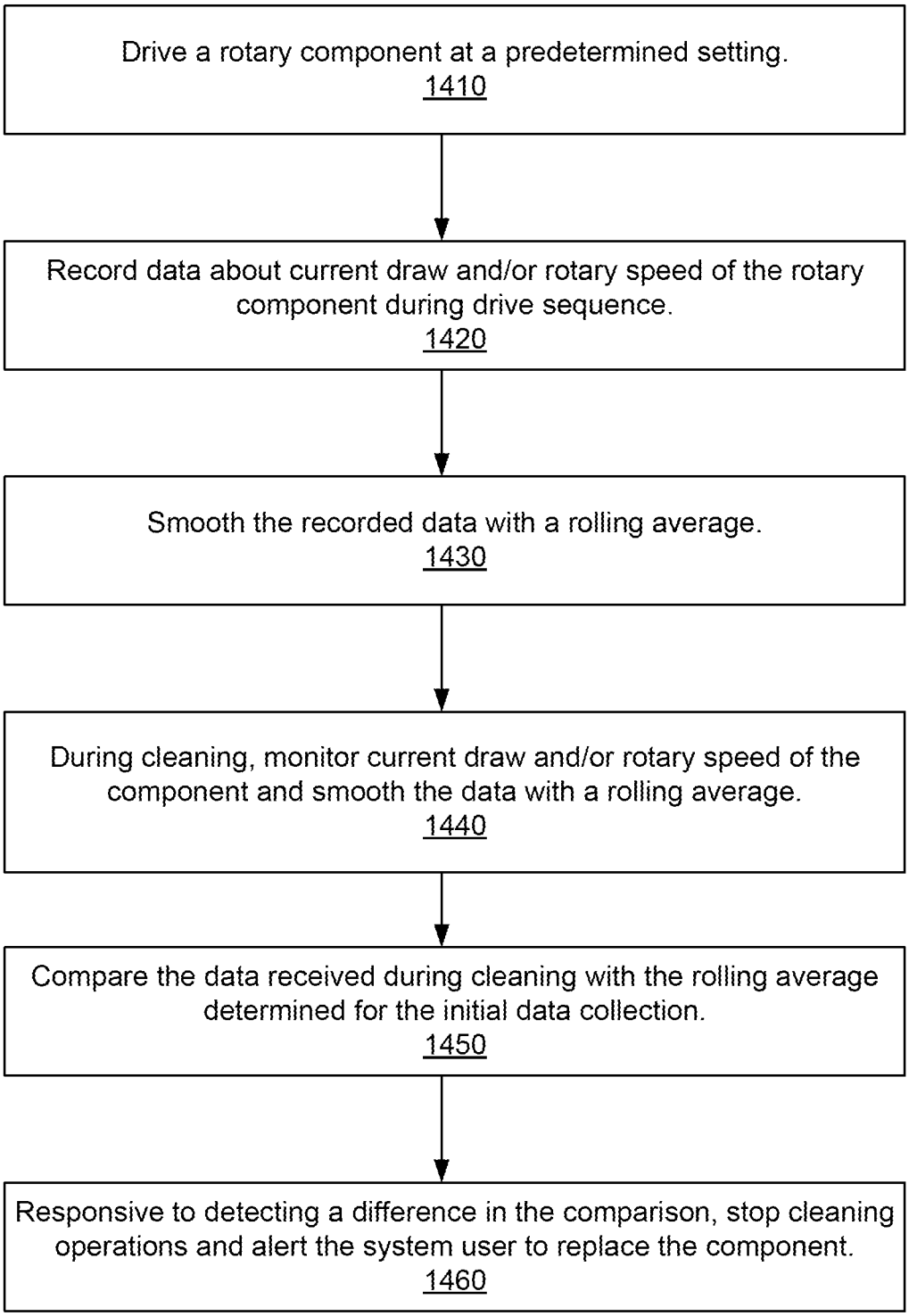
FIG. 14 is a flowchart illustrating a process for rotary component presence detection, in accordance with an example embodiment.

FIG. 14 is a flowchart illustrating a process for rotary component presence detection, in accordance with an example embodiment. The rotary components presence detection routine may be performed by the controller 124 in conjunction with inputs that have been detected and processed by the sensor system 118 and/or input data received from the rotary components themselves. The rotary components presence detection routine performs startup and continuous checks to determine if any of the sweeper roller 144, mop roller 148, or side brush roller 154 have detached. Startup checks may be performed one at the beginning of a cleaning routine and may involve each of these rotary components being driven 1410 at a predetermined duty setting. The predetermined duty setting may be configured to maximize the measurable difference between the current draw and/or rotary speed of the component when the component is present and which the component is missing. While the rotary component is being driven the sensor system 118 records 1420 data about the current draw and/or the rotary speed associated with the rotary component. In one embodiment, the sensor system 118 may smooth 1430 the recorded data, for example by calculating a rolling average (e.g., over 1-3 seconds) of the incoming data from the rotary component. Later during a cleaning operation, the sensor system 118 monitors 1440 current draw and/or rotary speeds associated with the rotary component and smooths the incoming data with a rolling average. The controller 124 compares 1450 the data received during the cleaning operation to the initial data collection. Responsive to detecting a difference in the comparison, the controller 124 may stop 1460 cleaning operations of the autonomous vacuum 100 and may alter a user to check for and replace the missing rotary component. That is, during the cleaning operation itself, the routine continuously monitors the current draw and/or rotary speed from the rotary component, smooths these data with rolling averaging, and compares the rolling average against criteria concordant with a missing rotary component (e.g., low current draw, high rotary speed).

Figure 15:
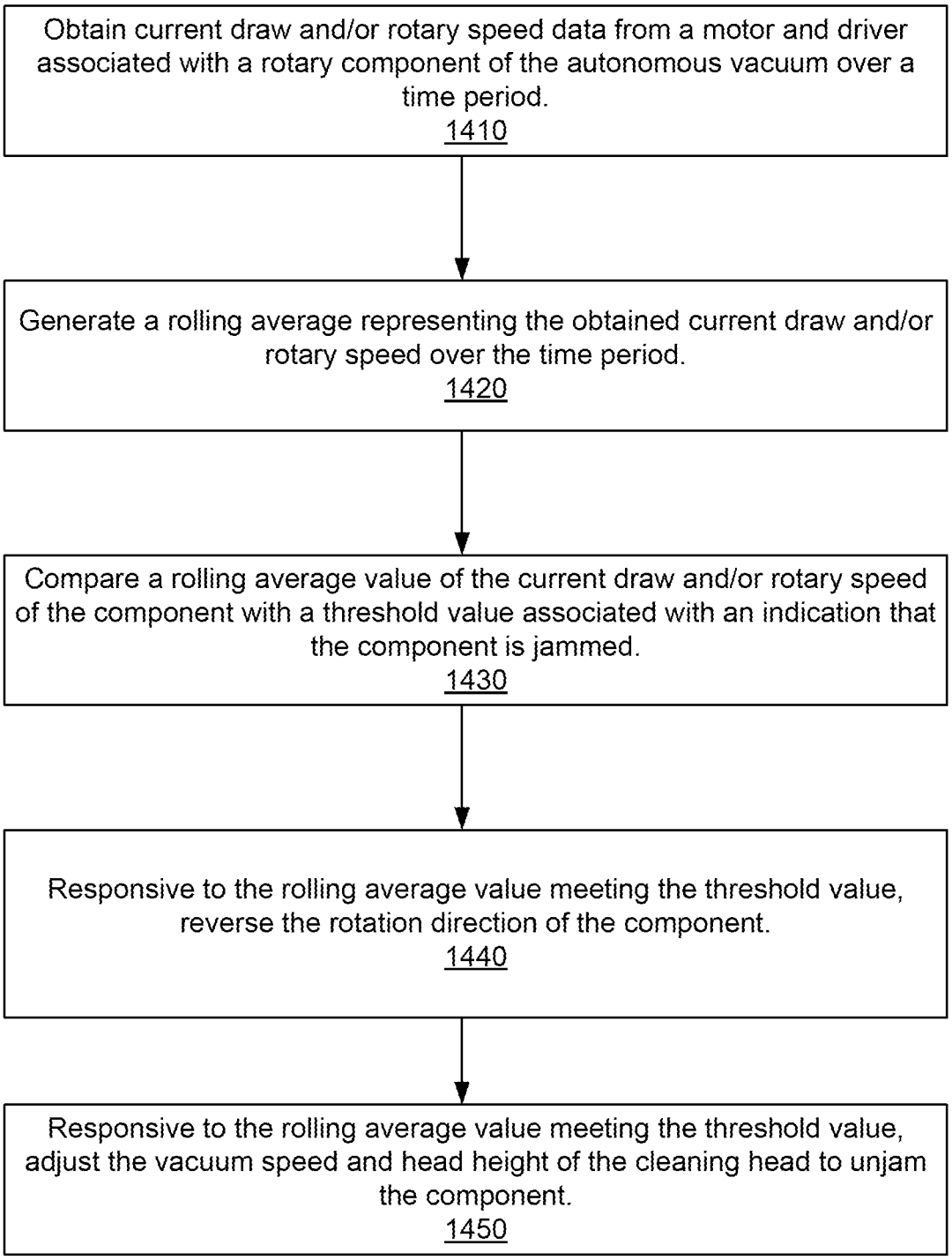
FIG. 15 is a flowchart illustrating a process for rotary component jam detection, in accordance with an example embodiment.

FIG. 15 is a flowchart illustrating a process for rotary component jam detection, in accordance with an example embodiment. The routines for detecting rotary component jams may be performed by the controller 124 in conjunction with inputs that have been detected and processed by the sensor system 118 and/or input data received from the rotary components themselves. The sweeper roller 144, mop roller 148, and side brush roller 154 are rotated with individual motors and drivers. The jam detection routine continuously obtains 1410 and monitors the current draw and/or rotary speed reported by the motor drivers during cleaning operations. These data may be smoothed by generating 1420 rolling averages over the observed time. The smoothed data are then compared 1430 with a threshold criteria value, which may be a preset value that is associated with an indication that the rotary component is jammed. For example, a threshold criteria value may be a higher than normal value of current draw that indicates that the motor is working extra hard to move the jammed rotary component. The threshold criteria value may differ for each of the rotary components of the autonomous vacuum 100 and there may be multiple values associated with a jam for any one rotary component. If the threshold criteria indicating a jam is met, the controller 124 may initiate an unjamming procedure that involves a sequence of reverse rotation 1440, adjustment of vacuum speed, and head height adjustments 1450 before returning to normal operation. Unjamming sequences may be unique to each rotary component. In some embodiments, if a few consecutive jams are detected on the same rotary component and if the current draw and/or rotary speed detected for the component does not improve after an unjamming sequence, then the controller 124 may cease cleaning operations and send an alert to the user to check the autonomous vacuum 100 for jams.

Figure 16:
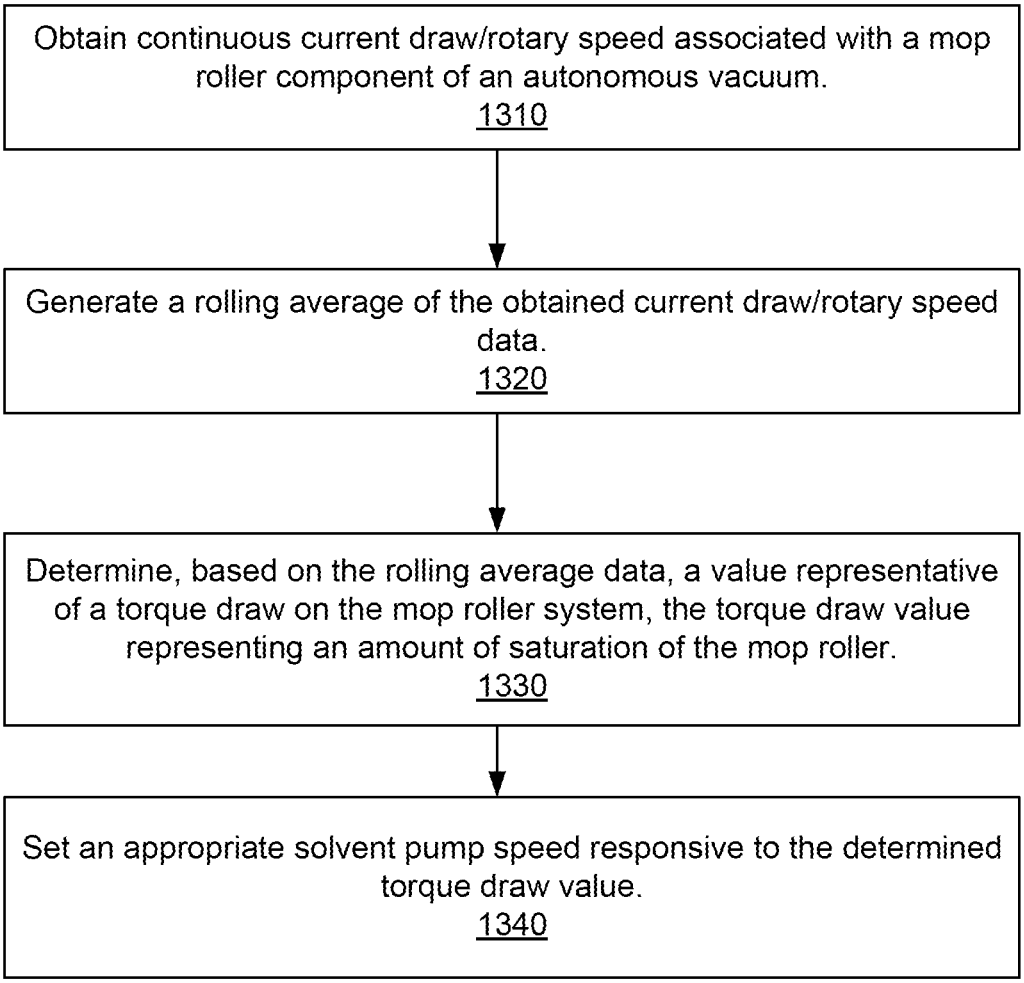
FIG. 16 is a flowchart illustrating a process for controlling saturation of the mop roller 145, in accordance with an example embodiment.

FIG. 16 is a flowchart illustrating a process for controlling saturation of the mop roller 145, in accordance with an example embodiment. The routine may be performed by the controller 124 in conjunction with inputs that have been detected and processed by the sensor system 118 and/or input data received from the rotary components. The routine uses a technique at the start of the mopping operation to set a flowrate of a solvent pump according to how wet or dry the mop roller 148 is beforehand. This prevents an already saturated mop roller 148 from becoming oversaturated (causing dripping) and maximizes the speed that a dry mop roller 148 can become saturated and ready to clean. The sensor system 118 continuously monitors and obtains 1310 current draw and/or rotational speed data from the mop roller 148 and generates 1320 a rolling average to smooth the obtained data for an initial time period of the mopping operation (e.g., for the first 20 seconds). The controller 124 determines 1330 a value representative of the torque draw on the mop roller system, where the torque draw value represents a saturation of the mop roller 148 (e.g., because a highly saturated mop roller 148 is lubricated and therefore easier to turn than a fluffy dry mop roller). The controller then sets 1340 an appropriate solvent pump speed to increase or decrease the amount of solvent that is dispensed depending on the torque draw value. After this initial period, steady state saturation is achieved at the mop roller 148.

Figure 17:
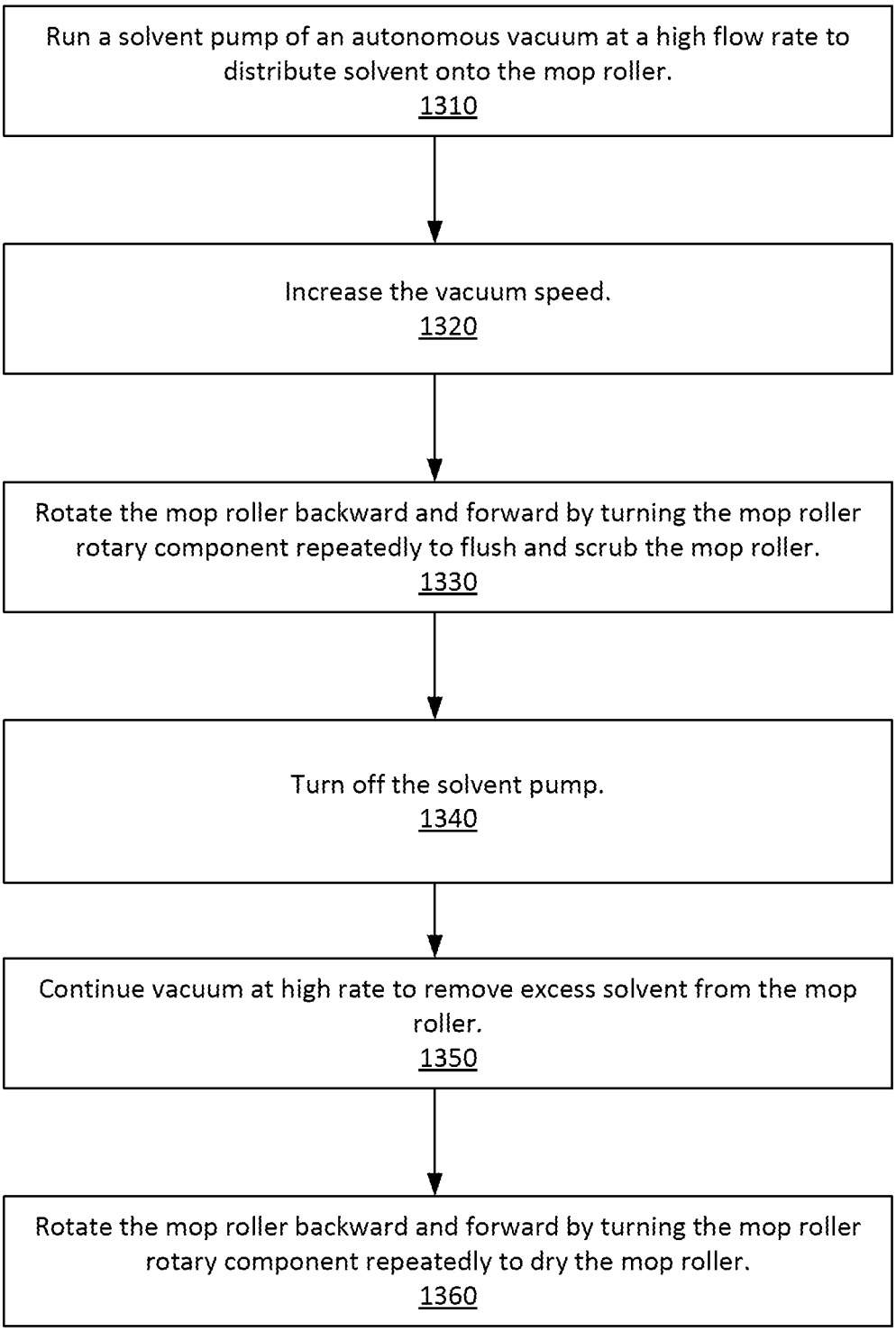
FIG. 17 is a flowchart illustrating a self-drying process for the mop roller, in accordance with an example embodiment.

FIG. 17 is a flowchart illustrating a self-drying process for the mop roller, in accordance with an example embodiment. The routine may be performed by the controller 124 in conjunction with inputs that have been detected and processed by the sensor system 118 and/or input data received from the rotary components. The mopping roller 148 is wet during typical operation, so it is desirable to dry it out as much as possible prior to the autonomous vacuum 100 executing sweeping sequences, charging, or being otherwise inactive. Therefore, at the end of a mopping operation, the autonomous vacuum may execute a sequence of operations that briefly cleans the mop roller 148 with water before performing a drying procedure. In some embodiments, the drying sequence may take 20-60 seconds to complete. The controller runs 1310 a solvent pump at a high flow rate to distribute solvent onto the mop roller 148 and also increases 1320 the vacuum speed. At the same time, the controller causes the mop roller 148 to rotate 1330 backward and forward by repeatedly turning the mop roller 148 rotary component to flush and scrub the mop roller 148. In one embodiment, this may involve scrubbing the mop roller 148 against a wringer component without taking in new debris from the environment. The controller then turns off 1340 the solvent pump, stopping the distribution of solvent. The vacuum continues 1350 at a high rate to remove excess solvent from the mop roller and rotates 1360 the mop roller 148 forward and backward by turning the mop 148 rotary component repeatedly to dry the mop roller 148 until the mop roller is drier.

Figure 18:
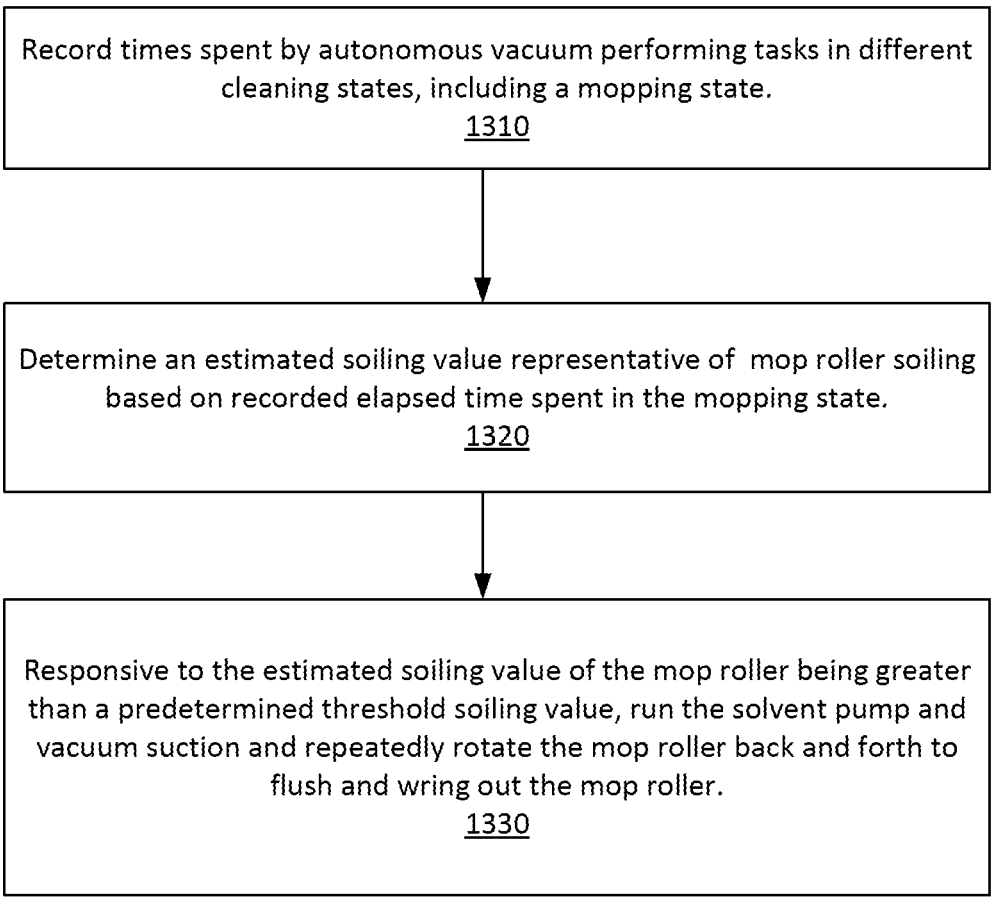
FIG. 18 is a flowchart illustrating a self-cleaning process for the mop roller, in accordance with an example embodiment.

FIG. 18 is a flowchart illustrating a self-cleaning process for the mop roller, in accordance with an example embodiment. The routine may be performed by the controller 124 in conjunction with inputs that have been detected and processed by the sensor system 118 and/or input data received from the rotary components themselves. The controller 124 of the autonomous vacuum system records 1310 times spent by the system in performing tasks in different cleaning states, such as the sweeping state and the mopping state. That is the controller may record a total elapsed runtime of components on the autonomous vacuum 100 (e.g., runtime of the different motors). The controller 124 uses the total elapsed use data to determine 1320 an estimated soiling value associated with the mop roller 148. In particular, the controller 124 may use information collected about the total time spent running mopping operations, combined with empirical data about debris accumulation rates in the mopping system to generate an estimate of a degree of soiling. When soiling estimates exceed predetermined soiling value for the mop roller 148, the controller 124 executes 1330 a cleaning procedure to clean the mop roller 148. The cleaning procedure may include running the solvent pump and vacuum at high settings while periodically switching the rotational direction of the mop roller 148. This action may be applied for 30-600 seconds and flushes and scrubs the mop roller 148. In some embodiments, the self-cleaning routine also accesses the sensor system 118 to determine that there is enough solvent available in the solvent tank to complete the cleaning process.

ADDITIONAL CONSIDERATIONS

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above disclosure.

Some portions of this description describe the embodiments of the invention in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments of the invention may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments of the invention may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based hereon. Accordingly, the disclosure of the embodiments of the invention is intended to be illustrative, but not limiting, of the scope of the invention, which is set forth in the following claims.

What is claimed is:

1. An autonomous vacuum comprising:

a drive system comprising a motor and a drive assembly, the drive system further comprising:

a body enclosure having a first side opposite a second side, a front side opposite a back side, and a top side opposite a bottom side that is substantially parallel to a cleaning surface;

a base-plate attached to the bottom side of the body enclosure; and one or more baseplate magnets rigidly attached to the baseplate and having exposed magnetic poles on the front side of the body enclosure;

a cleaning head structured to engage the cleaning surface, the cleaning head comprising:

a cleaning head enclosure having a first side opposite a second side, a front side opposite a back side, and a top side opposite the cleaning surface;

a first cleaning face of the cleaning head enclosure, the first cleaning face connected to the front side of the cleaning head enclosure and extended backward and downward at an angle from the front side of the cleaning head enclosure;

a second cleaning face of the cleaning head enclosure, the second cleaning face connected to the back side of the cleaning head enclosure and extended forward and downward at an angle from the back side of the cleaning head enclosure to intersect at an obtuse angle with the first cleaning face of the cleaning head enclosure;

a first opening within the first cleaning face, the first opening extending from the first side of the cleaning head enclosure to the second side of the cleaning head enclosure;

a second opening within the second cleaning face, the second opening extending from the first side of the cleaning head enclosure to the second side of the cleaning head enclosure;

a first roller comprising a cylindrical core with a first end and a second end, the first roller rotatably attached within the first opening such that the first end of the first roller is attached at the first side of the cleaning head enclosure and the second end of the first roller is attached at the second side of the cleaning head enclosure;

a second roller comprising a cylindrical core with a first end and a second end, the second roller rotatably attached within the second opening such that the first end of the second roller is attached at the first side of the cleaning head enclosure and the second end of the second roller is attached at the second side of the cleaning head enclosure;

a back tube comprising an exterior surface surrounding a hollow core, a first end of the back tube, and a second end of the back tube, the first end of the back tube attached to the back side of the cleaning head enclosure and the hollow core positioned to direct the second end of the back tube upward away from the cleaning surface; and one or more cleaning head magnets rigidly attached to the exterior surface of the back tube opposite the back side of the cleaning head and exposed, each of the one or more cleaning head magnets in alignment with the exposed magnetic poles of a corresponding one of the one or more base-plate magnets;

a connection system that attaches the back tube of the cleaning head to the front side of the drive system, the connection system comprising:

one or more four-bar linkages that secure the back side of the cleaning head enclosure to the front side of the body enclosure of the drive system; and an actuator connected to the one or more four-bar linkages;

wherein the connection system attaches the cleaning head to the drive system in a first state wherein:

the cleaning head enclosure is raised away from the cleaning surface by the actuator;

the cleaning head enclosure is pitched forward such that the first cleaning face is substantially parallel to the cleaning surface and the first roller is exposed to the cleaning surface; and the exposed magnetic poles of the one or more cleaning head magnets are distanced from the exposed magnetic poles of the one or more base-plate magnets such that they do not significantly attract;

wherein the connection system attaches the cleaning head to the drive system in a second state wherein:

the cleaning head enclosure is lowered toward the cleaning surface by the actuator;

the cleaning head enclosure is pitched backward such that the second cleaning face is substantially parallel to the cleaning surface and the second roller is exposed to the cleaning surface; and the exposed magnetic poles of the one or more cleaning head magnets and the exposed magnetic poles of the one or more base-plate magnets firmly attract to one another, securing the cleaning head into position.

2. The autonomous vacuum of claim 1, wherein when the cleaning head is attached to the drive system in the second state, and the second roller is positioned over the cleaning surface such that driving the autonomous vacuum forward will cause the cleaning head to pitch into a magnetically secured position.

3. The autonomous vacuum of claim 1, wherein the first roller is a sweeper roller comprising sweeping bristles or flexible fins extending outward from the cylindrical core of the first roller.

4. The autonomous vacuum of claim 1, wherein the second roller is a mop roller comprising fabric bristles or loops along an outside of the cylindrical core of the second roller.

5. The autonomous vacuum of claim 1, wherein the cleaning head is positioned to pitch between the first state and the second state around a pivot point, the pivot point further comprising a pin assembly with a cylindrical pin that is connected at a first end to the first side of the cleaning head and at a second end to the second side of the cleaning head.

6. An autonomous vacuum comprising:

a drive system having a front side and a bottom side, the drive system further comprising:

a baseplate that is substantially parallel to a cleaning surface; and one or more base-plate magnets rigidly coupled with the baseplate and having exposed magnetic poles on a front edge of the baseplate;

a cleaning head enclosure with a back side, the cleaning head enclosure further comprising:

a back tube comprising an exterior surface surrounding a hollow core, a first end, and a second end, the first end of the back tube coupled with the back side of the cleaning head enclosure and the second end of the back tube directed upward away from the cleaning surface; and one or more cleaning head magnets having exposed magnetic poles and coupled with the exterior surface of the back tube opposite the back side of the cleaning head enclosure, wherein the exposed magnetic poles of the one or more cleaning head magnets align with the exposed magnetic poles of the one or more base-plate magnets; and a connection system coupling the back tube of the cleaning head enclosure to the front side of the drive system, the connection system including an actuator;

wherein in a first state, the connection system couples the cleaning head enclosure to the drive system such that:

the cleaning head enclosure is being in a vertically raised position away from the cleaning surface;

the cleaning head enclosure is in a pitched forward position; and the exposed magnetic poles of the one or more cleaning head magnets are distanced from the exposed magnetic poles of the one or more base-plate magnets preventing sufficient attraction;

wherein in a second state, the connection system couples the cleaning head enclosure to the drive system such that:

the cleaning head enclosure is in a vertically lowered position toward the cleaning surface;

the cleaning head enclosure is in a pitched backward position; and the exposed magnetic poles of the one or more cleaning head magnets firmly attract to the exposed magnetic poles of the one or more base-plate magnets.

7. The autonomous vacuum of claim 6, wherein the one or more base-plate magnets and the one or more cleaning head magnets each further comprise a surface having a friction and abrasion reducing coating, film, or thin enclosure.

8. The autonomous vacuum of claim 6, wherein the one or more base-plate magnets are positioned to place the exposed magnetic poles of each of the one or more base-plate magnets directionally away from the cleaning surface and the one or more cleaning head magnets are positioned to place the exposed magnetic poles of the one or more cleaning head magnets directionally toward the cleaning surface.

9. The autonomous vacuum of claim 6, wherein the one or more cleaning head magnets and the one or more base-plate magnets are paired such that there is a magnetic force between the exposed magnetic poles of the one or more base-plate magnets and the exposed magnetic poles of the one or more cleaning head magnets that is strong enough to attract and secure the exposed magnetic poles of the one or more base-plate magnets to the exposed magnetic poles of the one or more cleaning head magnets when the cleaning head enclosure is in the first state.

10. The autonomous vacuum of claim 6, wherein the one or more cleaning head magnets and the one or more base-plate magnets are paired with a magnetic force between the one or more cleaning head magnets and the one or more base-plate magnets that that enables release of the magnetic force by the actuator.

11. The autonomous vacuum of claim 6, wherein the one or more base-plate magnets and the one or more cleaning head magnets have an amount of magnetic adhesion force and an amount of magnetic shear force that, once secured into the second state, enables the one or more base-plate magnets and the one or more cleaning head magnets to disengage by retraction of the actuator.

12. The autonomous vacuum of claim 6, wherein the one or more base-plate magnets and the one or more cleaning head magnets secure the cleaning head enclosure into the second state with a magnetic shearing force that exists between the one or more base-plate magnets and the one or more cleaning head magnets.

13. The autonomous vacuum of claim 6, wherein the one or more base-plate magnets and the one or more cleaning head magnets are structured in a shape, material composition, and magnetic pole arrangement to satisfy force and motion requirements of securing the cleaning head enclosure in the first state and in the second state.

14. An autonomous vacuum comprising:

a drive system comprising a motor and a drive assembly, the drive system further comprising:

a body enclosure having a first side opposite a second side, a front side opposite a back side, and a top side opposite a bottom side that is substantially parallel to a cleaning surface;

a base-plate attached to the bottom side of the body enclosure; and one or more baseplate magnets rigidly attached to the baseplate and having exposed magnetic poles on the front side of the body enclosure;

a cleaning head structured to engage the cleaning surface, the cleaning head comprising:

a cleaning head enclosure having a first side opposite a second side, a front side opposite a back side, and a top side opposite the cleaning surface;

a first cleaning face of the cleaning head enclosure, the first cleaning face connected to the front side of the cleaning head enclosure and extended backward and downward at an angle from the front side of the cleaning head enclosure;

a second cleaning face of the cleaning head enclosure, the second cleaning face connected to the back side of the cleaning head enclosure and extended forward and downward at an angle from the back side of the cleaning head enclosure to intersect at an obtuse angle with the first cleaning face of the cleaning head enclosure;

a first opening within the first cleaning face, the first opening extended from the first side of the cleaning head enclosure to the second side of the cleaning head enclosure;

a second opening within the second cleaning face, the second opening extended from the first side of the cleaning head enclosure to the second side of the cleaning head enclosure;

a first roller comprising a cylindrical core with a first end and a second end, the first roller rotatably attached within the first opening, the first end of the first roller attached at the first side of the cleaning head enclosure and the second end of the first roller attached at the second side of the cleaning head enclosure;

a second roller comprising a cylindrical core with a first end and a second end, the second roller rotatably attached within the second opening, the first end of the second roller attached at the first side of the cleaning head enclosure and the second end of the second roller attached at the second side of the cleaning head enclosure;

a back tube comprising an exterior surface surrounding a hollow core, a first end, and a second end, the first end of the back tube attached to the back side of the cleaning head enclosure, the hollow core positioned to direct the second end of the back tube away from the cleaning surface; and one or more cleaning head magnets rigidly attached to the exterior surface of the back tube opposite the back side of the cleaning head and exposed, each of the one or more cleaning head magnets in alignment with the exposed magnetic poles of a corresponding one of the one or more baseplate magnets;

a connection system that attaches the back tube of the cleaning head to the front side of the drive system, the connection system comprising:

one or more four-bar linkages that secure the back side of the cleaning head enclosure to the front side of the body enclosure of the drive system;

an actuator connected to the one or more four-bar linkages; and one or more snorkel ducts, wherein each of the one or more snorkel ducts is a flexible elastomeric tube attached at a first end to the back side of the cleaning head and attached at a second end to a waste bag on the drive system;

wherein in a first state, the connection system attaches the cleaning head to the drive system such that:

the cleaning head enclosure is in a position that is raised away from the cleaning surface;

the cleaning head enclosure is in a pitched forward position that locates the first cleaning face substantially parallel to the cleaning surface and exposes the first roller to the cleaning surface;

the one or more snorkel ducts are kinked to substantially close the one or more snorkel ducts; and the exposed magnetic poles of the one or more cleaning head magnets are distanced from the exposed magnetic poles of the one or more baseplate magnets preventing sufficient attraction; and wherein in a second state, the connection system attaches the cleaning head to the drive system such that:

the cleaning head enclosure is in a position that is lowered toward the cleaning surface;

the cleaning head enclosure is in a pitched backward position that locates the second cleaning face substantially parallel to the cleaning surface and the second roller is exposed to the cleaning surface;

the one or more snorkel ducts are substantially open; and the exposed magnetic poles of the one or more cleaning head magnets and the exposed magnetic poles of the one or more baseplate magnets have an attraction force to releasably couple the one or more cleaning head magnets with the one or more baseplate magnets to secure the cleaning head in the second state.

15. The autonomous vacuum of claim 14, wherein the cleaning head further comprises wires, water tubes, sweeping ducts, and pressure tubes that extend through the back tube and connect to the drive system.

16. The autonomous vacuum of claim 15, wherein the wires, water tubes, sweeping ducts, snorkel ducts, and pressure tubes are positioned such that they add resistance to motion of the cleaning head about a pivot point.

17. The autonomous vacuum of claim 14, wherein the one or more snorkel ducts each have an inner diameter in a range of 4 millimeters (mm) to 25 mm.

18. The autonomous vacuum of claim 14, wherein the one or more snorkel ducts each have an inner diameter to wall thickness ratio in a range of 1:1 to 1:25.

19. The autonomous vacuum of claim 14, wherein one of the one or more four-bar linkages is positioned to stop forward pitching of the cleaning head when the cleaning head is transitioned in a forward direction around a pivot point into the first state.

20. The autonomous vacuum of claim 14, wherein one of the one or more four-bar linkages is positioned to stop backward pitching the cleaning head when the cleaning head is transitioned in a backward direction around a pivot point into the second state.

* * * * *